US006509519B2

(12) United States Patent
Tamura

(10) Patent No.: US 6,509,519 B2
(45) **Date of Patent: *Jan. 21, 2003**

(54) METHOD AND APPARATUS FOR GENERATING MUSICAL TONE WAVEFORMS BY USER INPUT OF SAMPLE WAVEFORM FREQUENCY

(75) Inventor: Motoichi Tamura, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/954,307

(22) Filed: Sep. 14, 2001

(65) Prior Publication Data

US 2002/0014146 A1 Feb. 7, 2002

Related U.S. Application Data

(62) Division of application No. 08/722,633, filed on Sep. 27, 1996, now Pat. No. 6,326,537.

(30) Foreign Application Priority Data

Sep. 29, 1995 (JP) ..... 7-275092
Oct. 2, 1995 (JP) ..... 7-254366

(51) Int. Cl.[7] ..... G10H 1/22; G10H 7/02; G10H 7/04

(52) U.S. Cl. ..... 84/603; 84/604; 84/605; 84/609; 84/618; 84/649; 84/676; 84/DIG. 2

(58) Field of Search ..... 84/603–607, 615–620, 84/DIG. 2, 622–633, 653–658, 662–665, 609–614, 649–652

(56) References Cited

U.S. PATENT DOCUMENTS 3,610,799 A 10/1971 Watson
3,743,755 A 7/1973 Watson
3,809,786 A 5/1974 Deutsch (List continued on next page.)

FOREIGN PATENT DOCUMENTS

| | | |
|---|---|---|
| EP | 0 376 342 A2 | 7/1990 |
| EP | 0 446 411 A2 | 1/1992 |
| GB | 2 040 537 | 8/1980 |
| JP | 63-88646 | 4/1988 |
| JP | 63-172196 | 7/1988 |
| JP | 64-19393 | 1/1989 |
| JP | 64-46138 | 2/1989 |
| JP | 64-77092 | 3/1989 |
| JP | 2-85895 | 3/1990 |
| JP | 6-83359 | 3/1994 |
| JP | 7-225582 | 8/1995 |
| WO | WO 80/01215 | 6/1980 |

OTHER PUBLICATIONS

"Microsoft Windows Operating Version 3", by Faun Zen Fon; Feb. 1992 (and English translation).

"Digidesign Turobysynth: Synthesis and Sound Processing for the Apple Macintosh", Computer Music Journal, vol. 12, No. 3, Fall 1988, pp 79–80.

(List continued on next page.)

*Primary Examiner*—Stanley J. Witkowski
(74) *Attorney, Agent, or Firm*—Morrison & Foerster LLP

(57) ABSTRACT

A method and apparatus for generating musical tones are provided. Musical tones are generated based on musical tone waveform samples generated through a plurality of channels, and performance information is input. Control information is input depending on an amount of operation of an operating element operated by a user. Musical tone waveform samples are generated for each of the channels corresponding to the performance information input within a predetermined time period, in a number corresponding to the input control information, whenever the predetermined time period elapses. Musical tones are generated based on the generated musical tone waveform samples.

32 Claims, 22 Drawing Sheets

U.S. PATENT DOCUMENTS

| | | | |
|---|---|---|---|
| 4,373,416 | A | 2/1983 | Endo et al. |
| 4,502,359 | A | 3/1985 | Sano |
| 4,554,857 | A | 11/1985 | Nishimoto |
| RE33,738 | E | 11/1991 | Okumura |
| 5,089,820 | A | 2/1992 | Gorai et al. |
| 5,111,727 | A | 5/1992 | Rossum |
| 5,121,667 | A | 6/1992 | Emery et al. |
| 5,220,117 | A | 6/1993 | Yamada et al. |
| 5,248,842 | A | 9/1993 | Saito |
| 5,283,386 | A | 2/1994 | Akutsu et al. |
| 5,410,099 | A | 4/1995 | Kosugi |
| 5,432,293 | A | 7/1995 | Nonaka et al. |
| 5,508,469 | A | 4/1996 | Kunimoto et al. |
| 5,532,424 | A | 7/1996 | Hideo |
| 5,567,901 | A | 10/1996 | Gibson et al. |
| 5,596,159 | A | 1/1997 | O'Connell |
| 5,629,490 | A | 5/1997 | Inaba |
| 5,661,253 | A | 8/1997 | Aoki |
| 5,663,514 | A | 9/1997 | Usa |
| 5,663,517 | A | 9/1997 | Oppenheim |
| 5,670,728 | A | 9/1997 | Ogai et al. |
| 5,677,504 | A | 10/1997 | Kurata |
| 5,689,079 | A | 11/1997 | Kosugi |
| 5,696,342 | A | 12/1997 | Shimizu |
| 5,831,193 | A | 11/1998 | Suzuki |

OTHER PUBLICATIONS

"Accelerando: A Real–Time, General Purpose Computer Music System", by Keith Lent, et al., Computer Music Journal, vol. 13, No. 4, Winter 1989, pp 54–64.

"Digidesign's Sound Acclerator: Lessons Lived and Learned", by Bill Lowe and Robert Currie, Computer Music Journal, vol. 13, No. 1, Spring 1989, pp 36–46.

Hal Chamberlin, "Music Applications of Microprocessors", Hayden Books, 1985, 2nd Edition, pp 639–703, 707–755 and 757–778.

TONE COLOR DATA

WAVEFORM DATA

INPUT BUFFER

TONE GENERATOR REGISTER

TONE COLOR DATA

BUFFER WB

OUTPUT BUFFER OB

INPUT BUFFER

TONE GENERATOR REGISTER

METHOD AND APPARATUS FOR GENERATING MUSICAL TONE WAVEFORMS BY USER INPUT OF SAMPLE WAVEFORM FREQUENCY

This is a division of U.S. patent application Ser. No. 08/722,633, filed Sep. 27, 1996, now U.S. Pat. No. 6,326, 537.

BACKGROUND OF THE INVENTION

1. Field of the Invention

This invention relates to a musical tone-generating method which generates musical tone waveforms by executing a musical tone-generating program by means of a programmable processing unit such as a CPU or a DSP (Digital Signal Processor), and also relates to a musical tone-generating apparatus which generates musical tone waveforms by executing a musical tone-generating program.

2. Prior Art

In a conventional tone generator or a conventional musical tone-generating program which generates musical tone waveforms, through computation, the sampling frequency, the maximum number of musical tones that can be generated at the same time, and the contents of processing of each musical tone are set beforehand, irrespective of the types of musical tones to be generated and conditions under which other processings such as background processing are executed.

In the conventional tone generator and the musical tone-generating program, however, the following inconveniences have been encountered:

(1) Musical tone-generating operations employed are fixed, and therefore in some cases, processings which are not necessary are executed, and in other cases, essential processings are not executed.

For example, in a tone generator or a musical tone-generating program which can generate musical tones simultaneously through a plurality of tone-generating channels, musical tones are generated through each tone-generating channel independently of those generated through the other channels, and the number of waveform samples to be generated per unit time is constant for all the tone-generating channels. Therefore, although musical tones generated through each channel have different characteristics from those generated through the other channels and have different qualities required according to the kinds of the musical tones, the same number of waveform samples are generated for all the tone-generating channels. As a result, the conventional tone generator or the musical tone-generating program performs wasteful operations for generating musical tones.

For example, to generate musical tones with frequency components over a broad frequency band, i.e. with a high quality, the operation for generating musical tone waveforms has to be carried out at a high sampling frequency (i.e. with a large number of samples), while to generate musical tones with frequency components only in a low frequency band, it suffices to perform the operation for generating musical tone waveforms at a low sampling frequency (i.e. with a small number of samples). Further, some music pieces require a large number of musical tones to be generated but with a low quality when they are performed, and other music pieces require only a small number of musical tones to be generated but with a high quality. Further, a tone-generating channel which generates musical tones for an outstanding part of a music piece to be performed, such as a leading part, is required to generate musical tones with a high quality, while a tone-generating channel which generates musical tones for an inconspicuous part such as a backing part, is allowed to generate musical tones with a degraded quality, giving almost no difference in sound quality to a listener.

Further, some types of musical tones require conversion of the pitch of musical tone waveforms thereof when they are generated, while other types of musical tones do not require such conversion of the pitch. Some types of musical tones require modulation by means of an LFO (Low Frequency Oscillator), while other types do not require the same. Some types of musical tones require tone color processing by means of a digital filter, while others do not require the same, and some types of musical tones require imparting effects thereto, while others do not require the same. The conventional tone generator, however, has fixed circuits, and therefore it is difficult to add a new processing or omit a dispensable processing to or from the original fixed processings, which requires addition of a complicated circuit.

(2) In a tone generator which is realized by software (software tone generator), the amount of operation by a CPU thereof dynamically changes depending upon the number of tone-generating channels which are currently under operation for generating musical tones and the contents of musical tone-generating operations performed by the tone generator. When a software tone generator program (hereinafter referred to as "the software tone generator") is implemented by a general-purpose computer in parallel with other application programs (hereinafter referred to as "the other applications"), the operation of the other applications can sometimes be unstable due to a change in the amount of operation by the software tone generator particularly an increase in the amount of operation.

(3) The amount of operation that can be allotted to the software tone generator to be processed is limited not only by the number and types of the other applications executed in parallel but also by the processing capacity of the processing unit which carries out the operation. Since the amount of operation allotted is thus severely limited and also the operation for generating musical tones is performed in a fixed or unversatile manner, even if a user wants to generate an increased number of musical tones at the same time but with a degraded quality, or to generate a smaller number of musical tones but with a high quality, he cannot choose either of the two operation modes.

SUMMARY OF THE INVENTION

It is a first object of the invention to provide a musical tone-generating method and a musical tone-generating apparatus which are capable of generating musical tones in either of a mode in which an increased number of musical tones are generated or a mode in which musical tones are generated with a high quality, depending on the user's choice, i.e. the purpose of use of musical tone generation.

It is a second object of the invention to provide a musical tone-generating method and a musical tone-generating apparatus which are capable of changing the contents of operation for generating musical tone waveforms, depending on the contents of musical tones to be generated and applications executed in parallel with the operation for generating musical tone waveforms.

To attain the first object, according to a first aspect of the invention, there are provided a method of generating musical tones, comprising a musical tone-generating step of generating musical tones, based on musical tone waveform samples generated through a plurality of channels, a performance information-inputting step of inputting performance information, a control information-inputting step of inputting control information depending on an amount of operation of an operating element operated by a user, and a musical tone waveform sample-generating step of generating musical tone waveform samples for each of the channels corresponding to the performance information input within a predetermined time period, in a number corresponding to the input control information, whenever the predetermined time period elapses, the musical tone-generating step generating musical tones, based on the generated musical tone waveform samples, and an apparatus for generating musical tones, comprising musical tone-generating means for generating musical tones, based on musical tone waveform samples generated through a plurality of channels, performance information-inputting means for inputting performance information, control information-inputting means for inputting control information depending on an amount of calculation of an operating element operated by a user, and musical tone waveform sample-generating means for generating musical tone waveform samples for each of the channels corresponding to the performance information input within a predetermined time period, in a number corresponding to the input control information, whenever the predetermined time period elapses, the musical tone-generating means generating musical tones, based on the generated musical tone waveform samples.

As a result, musical tones can be generated in either of a mode in which an increased number of musical tones are generated or a mode in which musical tones are generated with a high quality, depending on the user's choice.

To attain the first object, according to a second aspect of the invention, there are provided a method of generating musical tones, comprising a musical tone-generating step of generating musical tones, based on musical tone waveform samples generated through a plurality of channels, a performance information-inputting step of inputting performance information for a plurality of parts, a control information-setting step of setting control information for each of the parts, and a musical tone waveform sample-generating step of assigning the input performance information to at least part of the channels, and generating musical tone waveform samples through the at least part of the channels, in response to the input performance information, at a time density corresponding to the set control information for each of the parts corresponding to the input performance information, the musical tone-generating step generating musical tones, based on the generated musical tone waveform samples, and an apparatus for generating musical tones, comprising musical tone-generating means for generating musical tones, based on musical tone waveform samples generated through a plurality of channels, performance information-inputting means for inputting performance information for a plurality of parts, control information-setting means for setting control information for each of the parts, and musical tone waveform sample-generating means for assigning the input performance information to at least part of the channels, and for generating musical tone waveform samples through the at least part of the channels, in response to the input performance information, at a time density corresponding to the set control information for each of the parts corresponding to the input performance information, the musical tone-generating means generating musical tones, based on the generated musical tone waveform samples.

As a result, a part having a larger listening effect can be generated with a high quality, to thereby enable making the most of the limited processing capacity of the musical tone-generating apparatus.

To attain the first object, according to a third aspect of the invention, there are provided a method of generating musical tones, comprising a musical tone-generating step of generating musical tones, based on musical tone waveform samples, a performance information-inputting step of inputting performance information, a control information-generating step of generating control information, and a musical tone waveform sample-generating step of carrying out a musical tone-generating calculation based on waveform data stored in a waveform memory beforehand, in response to the input performance information, to thereby generate musical tone waveform samples at a time density corresponding to the generated control information, the musical tone waveform sample-generating step carrying out the musical tone-generating calculation by selectively using different data of the waveform data stored in the waveform memory according to the generated control information, the musical tone-generating step generating musical tones, based on the generated musical tone waveform samples generated by the musical tone-generating calculation, and an apparatus for generating musical tones, comprising musical tone-generating means for generating musical tones, based on musical tone waveform samples, performance information-inputting means for inputting performance information, control information-generating means for generating control information, a waveform memory for storing waveform data, and musical tone waveform sample-generating means for carrying out a musical tone-generating calculation based on waveform data stored in the waveform memory, in response to the input performance information, to thereby generate musical tone waveform samples at a time density corresponding to the generated control information, the musical tone waveform sample-generating means carrying out the musical tone-generating calculation by selectively using different data of the waveform data stored in the waveform memory according to the generated control information, the musical tone-generating means generating musical tones, based on the generated musical tone waveform samples generated by the musical tone-generating calculation.

As a result, in a channel for generating musical tones at a high equivalent sampling frequency, waveform data having frequency components over a broad band (with a high recording sampling frequency) can be processed, while in a channel for generating musical tones at a low equivalent sampling frequency, waveform data having frequency components over a narrow band (with a low recording sampling frequency) can be processed. This makes it unnecessary to change designation of a waveform in the tone color data.

If waveform data to be selected is not changed according to the time density of musical tone waveform samples to be generated, aliasing noises can be generated in generated musical tone waveform samples, or a musical tone with a quality corresponding to the time density cannot be generated for the following reasons. The time density means a sampling frequency at which musical tone waveform samples are generated, which is designated an equivalent sampling frequency, in the present specification. According to the sampling theorem, reproduced musical tone waveform samples can have frequency components in a frequency band equal to or less than half of the recording sampling frequency (hereinafter referred to as "the upper limit frequency") of the original musical tone waveform.

When musical tones are generated by using waveform data stored in a waveform memory, the stored waveform data is converted into waveform samples having a pitch of musical tones to be generated (hereinafter referred to as "the pitch conversion") at an equivalent frequency, and musical tone waveforms are generated based on waveform data after the pitch conversion. In this case, when the waveform data obtained by the pitch conversion contains frequency components higher than the upper limit frequency corresponding to the equivalent frequency, the frequency components are mixed into the waveform data after the pitch conversion as aliasing noises. On the other hand, if the waveform data obtained after the pitch conversion contains only frequency components much lower than the upper limit frequency, e.g. frequency components ⅓ times of the upper limit frequency, in spite of waveform generation at a high equivalent sampling frequency, only musical tones devoid of high frequency band components are generated, resulting in not so much an improvement in the quality of generated musical tones.

In the third aspect, waveform data for generating musical tones are prepared, which are suitable for respective time densities for generating musical tone waveform samples, and the waveform data are selectively used depending on the time density which is required for generating musical tones.

To attain the first object, according to a fourth aspect of the invention, there is provided a method of generating musical tones, comprising a first storing step of storing in memory means first waveform data for generating musical tones at a predetermined sampling frequency, a second storing step of converting the stored first waveform data to waveform data sampled at a sampling frequency different from the predetermined sampling frequency, and storing the waveform data sampled at the different sampling frequency in the memory means as second waveform data, and a musical tone waveform sample-generating step of generating musical tone waveform samples, based on the first waveform data or the second waveform data stored in the memory means, the musical tone waveform sample-generating step being capable of generating the musical tone waveform samples at a plurality of different time densities, by selecting the first waveform data or the second waveform data according to the different time densities and generating the musical tone waveform data based on the selected first or second waveform data.

According to the fourth aspect, similarly to the third aspect, aliasing noises can be eliminated. Further, musical tone waveform samples can be generated which sound as the same tone color while having been generated at different time densities.

Preferably, the method according to the fourth aspect includes a control information-generating step of generating control information, and the time densities are selected according to the generated control information.

To attain the second object, according to a fifth aspect of the invention, there are provided a method of generating musical tones, comprising a performance information-inputting step of inputting performance information, a selection information-inputting step of inputting selection information, a musical tone waveform-generating step of carrying out a musical tone waveform calculation in response to the input performance information, for generating musical tone waveforms, and a musical tone-generating step of generating musical tones by selectively subjecting the generated musical tone waveforms to a plurality of characteristic control processings according to the input selection information, the characteristic control processings having different processing contents and calculation amounts from each other, and an apparatus for generating musical tones, comprising performance information-inputting means for inputting performance information, selection information-inputting means for generating selection information, musical tone waveform-calculating means for carrying out a musical tone waveform calculation in response to the input performance information, for generating musical tones, and musical tone waveform-generating means for generating musical tones by selectively subjecting the generated musical tone waveforms to a plurality of characteristic control processings according to the input selection information, the characteristic control processings having different processing contents and calculation amounts from each other.

As a result, the contents of musical tone control processings are changed or the amount of processing is reduced by not carrying out a specific musical tone control according to the purpose of performance or the performance mode of musical tones to be generated, thereby enabling increasing the number of musical tones to be generated by the reduced amount of processing or using the CPU power for another purpose.

Preferably, the method according to the fifth aspect includes a display step of displaying on display means an amount of calculation required by the musical tone waveform calculation and a number of musical tones generated by the musical tone waveform calculation.

More preferably, the selection information is information for adding or omitting at least one characteristic control element used by the characteristic control processings to which the generated musical tone waveforms are subjected, an amount of calculation by the musical tone waveform calculation required for generating a musical tone waveform for one musical tone varying according to the addition or omission of the at least one characteristic control element.

The at least one characteristic control element includes, for example, modulation by means of an LFO (Low Frequency Oscillator), interpolation, digital filter processing, and reverberation processing.

To attain the second object, according to a sixth aspect of the invention, there are provided a method of generating musical tones, comprising a performance information-inputting step of inputting performance information, a limitation information-inputting step of inputting limitation information, and a musical tone waveform-generating step of carrying out a musical tone waveform calculation in response to the input performance information, for generating musical tone waveforms, the musical tone waveform-generating step generating musical tone waveforms by the musical tone waveform calculation which has an amount of calculation thereof limited in range by the limitation information, and an apparatus for generating musical tones, comprising performance information-inputting means for inputting performance information, limitation information-inputting means for inputting limitation information, and musical tone waveform-calculating means for carrying out a musical tone waveform calculation in response to the input performance information, for generating musical tones, the musical tone waveform-calculating means generating musical tone waveforms by the musical tone waveform calculation which has an amount of calculation thereof limited in range by the limitation information.

As a result, the amount of calculation is limited, and musical tone waveform data generated by the limited amount of calculation can be read and reproduced in a stable manner without interruption. In other words, even if the amount of calculation for generating musical tones is changed on a real-time basis, a predetermined amount of CPU power is surely preserved for other applications and therefore the other applications can be executed in a stable manner in parallel with the operation of the software tone generator.

Preferably, the method according to the sixth aspect includes a display step of displaying on display means an amount of calculation required by the musical tone waveform calculation and a number of musical tones generated by the musical tone waveform calculation.

To attain the second object, according to a seventh aspect of the invention, there are provided a method of generating musical tones, comprising a performance information-inputting step of inputting performance information, a calculation accuracy information-inputting step of inputting calculation accuracy information, and a musical tone waveform-generating step of carrying out a musical tone waveform calculation in response to the input performance information, for generating musical tone waveforms, the musical tone waveform-generating step generating musical tone waveforms by the musical tone waveform calculation which has calculation accuracy thereof designated by the input calculation accuracy information, and an apparatus for generating musical tones, comprising performance information-inputting means for inputting performance information, calculation accuracy information-inputting means for inputting calculation accuracy information, and musical tone waveform-calculating means for carrying out a musical tone waveform calculation in response to the input performance information, for generating musical tone waveforms, the musical tone waveform-calculating means generating musical tone waveforms by the musical tone waveform calculation which has calculation accuracy thereof designated by the input calculation accuracy information.

As a result, the calculation accuracy can be set according to the degree of tone quality required for generated musical tones or the amount of calculation available for processing.

The calculation accuracy information means, for example, the equivalent sampling frequency (the number of musical tone waveform samples to be generated per unit time), and by degrading the accuracy of calculation, the amount of calculation can be reduced.

Preferably, the method according to the seventh aspect includes a display step of displaying on display means an amount of calculation required by the musical tone waveform calculation and a number of musical tones generated by the musical tone waveform calculation.

To attain the second object, according to an eighth aspect of the invention, there is provided an apparatus for generating musical tones, comprising tone-generating information-storing means for storing tone-generating information, musical tone waveform-generating means for generating musical tone waveforms, based on the stored tone-generating information, and for changing a maximum number of musical tones to be generated simultaneously based on the stored tone=generating information, control information-generating means for generating control information indicative of a current value of the maximum number of musical tones to be generated simultaneously by the musical tone waveform-generating means, performance information-inputting means for inputting performance information, and control means for converting the input performance information to the tone-generating information according to the generated control information and writing the tone-generating information according to the generated control information into the tone-generating information-storing means.

As a result, the maximum number of tone-generating channels to be sounded simultaneously, which is set by a user or automatically changed, can be monitored on a tone generator driver side, and therefore the tone generator driver can suitably assign tone generation to tone-generating channels of the tone generator at any time, in response to input performance information.

Further, according to the invention, to attain the first and second objects, there are provided machine-readable storage mediums storing instructions to cause a machine to perform respective methods of generating musical tones according to the first to eighth aspects of the invention, which are set forth hereinabove.

The above and other objects, features, and advantages of the invention will be more apparent from the following detailed description taken in conjunction with the accompanying drawings.

BRIEF DESCRIPTION OF THE DRAWINGS

FIGS. 2A to 2D show formats of various data stored in a RAM appearing in FIG. 1, wherein:

FIG. 2A shows a format of tone color data stored in the RAM;

FIG. 2B shows a format of waveform data stored in the RAM;

FIG. 2C shows a format of event data stored in an input buffer preset in the RAM; and FIG. 2D shows a format of data stored in a tone generator register preset in the RAM;

FIGS. 12A to 12D show an example of frequency characteristics of waveform data is generated by the waveform LPF processing of FIG. 11, wherein:

FIG. 12A shows a frequency characteristic of the original waveform data;

FIG. 12B shows a frequency characteristic of waveform data after execution of band limit processing;

FIG. 12C shows a frequency characteristic of waveform data after execution of down-sampling; and FIG. 12D shows a frequency characteristic of waveform data after execution of LPF processing;

FIGS. 14A to 14D show formats of various data stored in a RAM of a musical tone-generating apparatus according to a second embodiment of the invention, wherein:

FIG. 14A shows a format of tone color data stored in the RAM;

FIG. 14B shows a format of waveform data stored in the RAM;

FIG. 14C shows a format of event data stored in an input buffer preset in the RAM;

FIG. 14D shows a format of data stored in a tone generator register preset in the RAM.

DETAILED DESCRIPTION

The invention will now be described in detail with reference to the drawings showing embodiments thereof.

Figure 1:
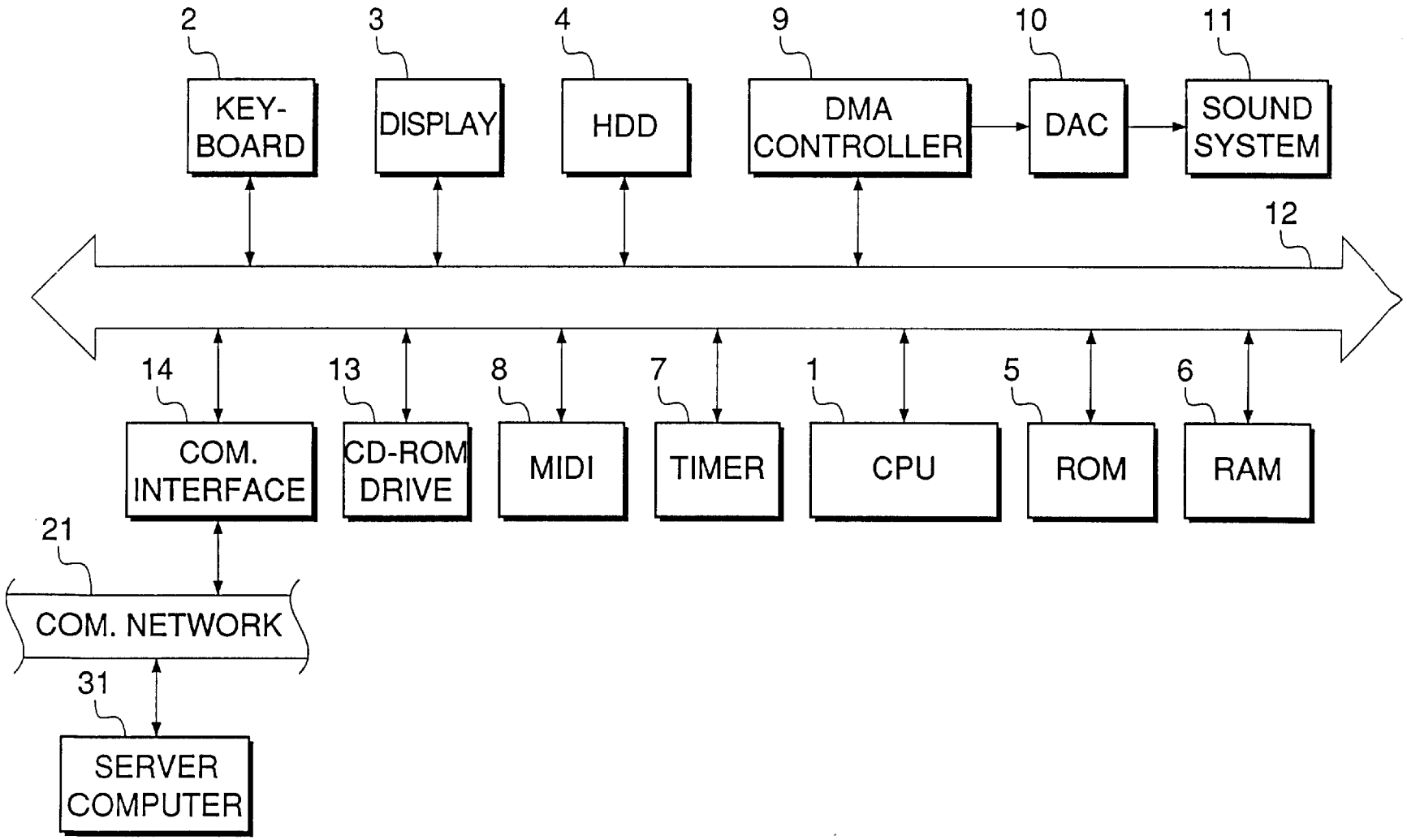
FIG. 1 is a block diagram showing the arrangement of a musical tone-generating apparatus according to an embodiment of the invention.

Referring first to FIG. 1, there is illustrated the arrangement of a musical tone-generating apparatus according to a first embodiment of the invention. The block diagram of FIG. 1 shows the arrangement of a general purpose computer per se, to which an operating system (OS) such as Windows (Registered Trademark) is applicable. Therefore, this invention can be implemented as software on a general purpose computer. Further, this invention is applicable to an electronic musical instrument having substantially the same arrangement as in FIG. 1.

The apparatus according to the present embodiment is comprised of a CPU 1 for performing various data processings, a keyboard 2 through which a user inputs program execution commands and data, a display unit 3 for displaying various image and character information, a hard disk drive (HDD) 4 storing data and programs executed by the CPU 1, a ROM 5 storing programs for controlling data inputting/outputting to and from the keyboard 1, the display unit 3 and the HDD 4, a RAM 6 for storing programs being executed, waveform data and data calculated, a timer 7, a MIDI interface 8 connected to a performance unit like a keyboard to be supplied with performance data therefrom, a DMA (direct memory access) controller 9 for directly accessing the RAM 6 to read therefrom musical tone sample data (waveform data) at a rate corresponding, e.g., to a sampling frequency of 48 kHz and delivering the read data, sample by sample, to a D/A converter 10 in response to a command from the CPU 1 (hereinafter referred to as "the reading-reproducing processing), the D/A converter 10 for converting the musical tone-generating data in the form of a digital signal supplied from the DMA controller 9 to an analog musical tone signal, a sound system 11 for amplifying and outputting the musical tone signal by way of a loudspeaker, and a bus 12 interconnecting the component elements 1 to 9.

The HDD 4 stores an operating program and various data including automatic performance data and code progression data. In the case where any operating program is not stored in the ROM 5, an operating program may be stored in a hard disk within the HDD 4. This operating program is read into the RAM 6 so that the CPU 1 operates on the operating program in the same way as if an operating program is stored in the ROM 5. By so doing, the addition of an operating program and version-up of the operating program are facilitated. A CD-ROM (compact disk read-only memory) drive 13 is also connected to the bus 12, which reads an operating program and various data stored in a CD-ROM set therein. The operating program and various data thus read out are stored in the hard disk within the HDD 4. It is thus easy to install a further operating program or a new version of the operating program. Devices for utilizing various types of media including a floppy disk drive and a magneto-optical (MO) disk drive may also be provided as external storage devices.

A communication interface 14 is also connected to the bus 12. The communication interface 14 is connected to a communication network 21 such as a LAN (local area network), an internet or a telephone line. The communication interface 14 is connected to a server computer 31 through the communication network 21. In the case where the operating program and various data are not stored in the HDD 4, the communication interface 14 is used to download programs and data from the server computer 31. The present musical tone-generating apparatus constituting a client transmits a command requesting the server computer 31 to download an operating program and data through the communication interface 14 and the communication network 21. The server computer 31 receives this command and delivers the requested operating program and data to the musical tone-generating apparatus through the communication network 21. The musical tone-generating apparatus receives the program and data through the communication interface 14 and accumulates them in the HDD 4. The downloading is thus completed.

The present invention may alternatively be implemented by the use of a commercially available personal computer or the like with an operating program and data adapted to the invention installed therein. In such a case, a storage medium such as a CD-ROM or a floppy disk which stores the operating program and data adapted to the invention and can be read by a personal computer can be offered to the user. In the case where such a personal computer or the like is connected to a communication network like a LAN, an internet or a telephone line, the operating program and the data can be offered to the personal computer or the like through the communication network.

Throughout the present specification, the term "waveform sample(s)" or "sample(s)" means a waveform sample (waveform samples) obtained by sampling original waveform data, the term "waveform data" those data of a sequence of waveform samples which are actually used to generate musical tones, the term "musical tone waveform data" data produced from the sequence of waveform samples by a musical tone-generating operation, and the term "musical tone waveform sample" a waveform sample (waveform samples) of the musical tone waveform data produced by the musical tone-generating operation.

FIGS. 2A to 2D show formats of tone color data and waveform data stored in the RAM 6 and data stored in an input buffer and a tone generator register present on the RAM 6.

Figure 2A:
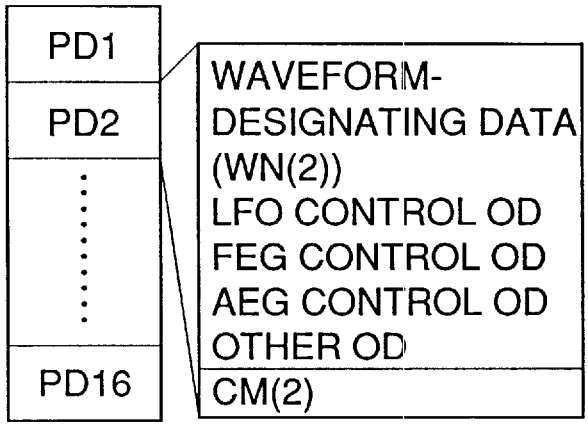

FIG. 2A shows tone color data PDp (p=1, . . . , 16) stored in the RAM 6, which is comprised of waveform-designating data WN(p) for designating a waveform of a range, LFO (low frequency oscillator) control original data (OD), filter envelope generator (FEG) control original data, amplitude envelope generator (AEG) control original data, other original data, and calculation mode CM(p). The symbol p represents a part number, and the musical tone-generating apparatus of the present embodiment is adapted to set tone color data for 16 parts. Further, in the present embodiment, the waveform-designating data WN(p) is set by a waveform name, which is set by the user (see FIG. 9). The calculation mode CM(p) is data for indirectly designating the number of samples to be generated per second for generating a musical tone waveform, i.e. data corresponding to an equivalent sampling frequency. According to the present embodiment, the calculation mode CM(p) can selectively assume an integer from 0 to 2 is selected. In the present embodiment, the calculation mode CM(p) and the equivalent sampling frequency are set in the relationship of CM(0)=48 kHz, CM(1)=24 kHz, and CM(2)=12 kHz.

Figure 2B:
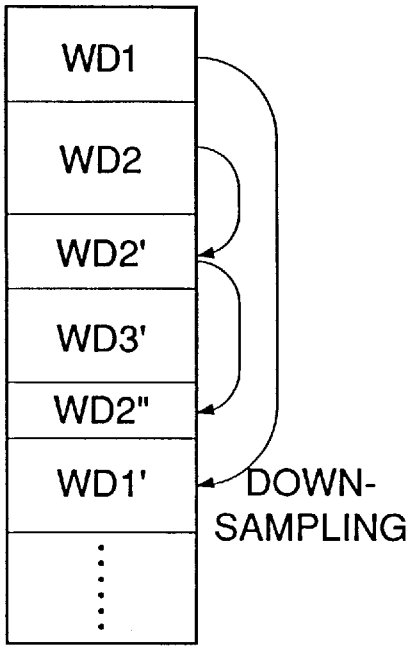

FIG. 2B shows waveform data WD1, WD2, . . . which are original waveform data for forming musical tone waveform data generated by musical tone-generating processing, hereinafter described. Among them, the waveform data WD1 and WD2 are each formed of samples having a length corresponding to a predetermined time period and each indicate a waveform which can be read out at one time or a waveform formed by an attack section and a loop section. The waveform data WD1 and WD2 are each obtained by reading out one of a plurality of waveform data which were previously sampled at a predetermined recording sampling frequency and stored in the HDD 4, according to necessity, and storing the read data in a waveform data area in the RAM 6. Waveform data WD1' and WD2' in FIG. 2B are obtained by subjecting the waveform data WD1 and WD2 to predetermined band limiting processing, down-sampling the band-limited data at a frequency ½ times of the original recording sampling frequency (by skipping every other sample), and storing the resulting down-sampled data in the waveform data area. Waveform data WD2" in FIG. 2B is obtained by subjecting the waveform data WD2' to predetermined band limiting processing, down-sampling the band-limited data at a frequency ½ times of the sampling frequency of the waveform data WD2, i.e. at a frequency ¼ times of the original recording sampling frequency, and storing the resulting data in the waveform data area. Processing for generating the waveform data WD1', WD2' and WD2" (Waveform LPF Processing) will be described hereinafter with reference to FIG. 11.

Figure 2C:
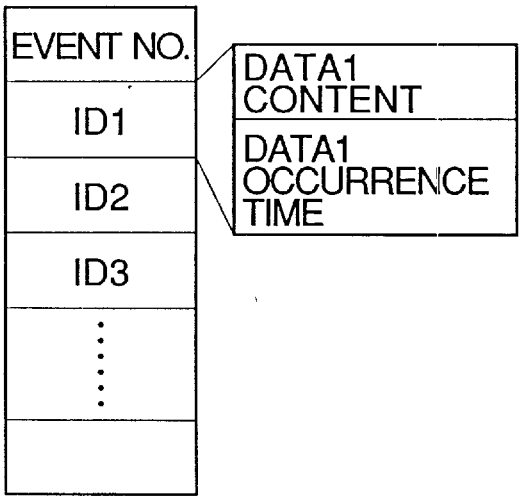

FIG. 2C shows an input buffer which stores performance data input through the MIDI interface 8. This input buffer is comprised of an area for storing data indicative of the number of events to be processed, and areas for storing event data ID1, ID2, ID3, and so on, corresponding to respective events. Each event data is comprised of data indicative of the contents of the event, and data indicative of a time point of occurrence of the event. The data indicative of the time point of event occurrence is required for the CPU 1 to process a plurality of events collectively.

Figure 2D:
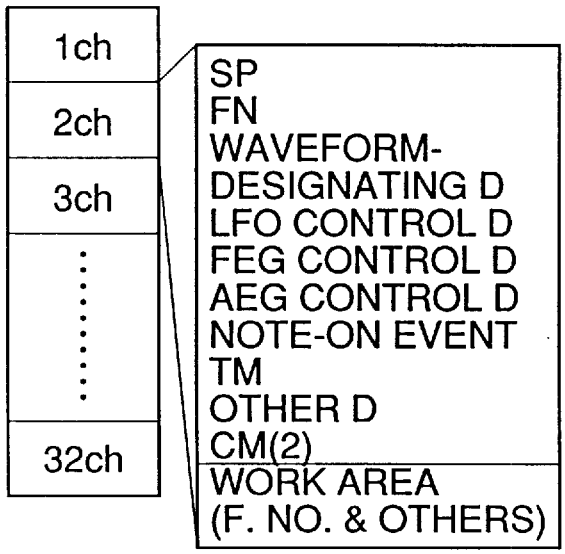

FIG. 2D shows a tone generator register which stores control data for each tone-generating channel, which are used in the musical tone-generating processing. In the present embodiment, the tone generator register is comprised of registers for 32 channels. The control data for each musical tone-generating channel are obtained by processing the respective original data of the tone color data PDp (see FIG. 2A) according to performance data such as touch, and comprised of pitch SP indicative of the pitch of a musical tone to be generated, an F number FN indicative of an address-advancing amount per sample by which waveform data is read out, waveform-designating data for designating waveform data to be read out, LFO control data obtained by processing the LFO control original data, FEG control data obtained by processing the FEG control original data, AEG control data obtained by processing the AEG control original data, note-on data (1-bit data) indicative of whether or not a musical tone is being sounded, other data, and calculation mode CM(i) (i=1, . . . 32).

The F number FN is a numerical value of the address-advancing amount per sample, which is calculated by the use of the following equation (1):

$$FN=2^{(SP-OP)/1200}\times 2^{(CM-WM)} \quad (1)$$

where SP represents the pitch SP of a musical tone to be generated, OP the pitch (original pitch) inherent in waveform data which is designated by the waveform-designating data and read, sample by sample, at the sampling frequency of 48 kHz, CM the calculation mode CM(i), and WM waveform mode indicative of a sampling frequency at which the musical tone was recorded (recording sampling frequency), i.e. a numerical value allotted to each waveform data and indirectly indicative of the recording sampling frequency of the waveform data (in the present embodiment, the waveform mode assumes an integer from 0 to 2, similarly to the calculation mode CM(i)). For example, the waveform mode WM=0 corresponds to a recording sampling frequency of 40 to 48 kHz, WM=1 to a recording sampling frequency of 20 to 24 kHz, and WM=2 to a recording sampling frequency of 10 to 12 kHz. Each waveform data to which is allotted a value (i) of the waveform mode can have a high frequency component which has an upper limit frequency value equal to half of the recording sampling frequency. The values SP and OP are divided by 1200 because these values are given in cent values.

The F number FN controls the pitch conversion mode.

Further, the tone generator register has provided therein a work area for tone generation processing. This work area is used when correction of the F number FN, for example, by the LFO control data is required.

Figure 3:
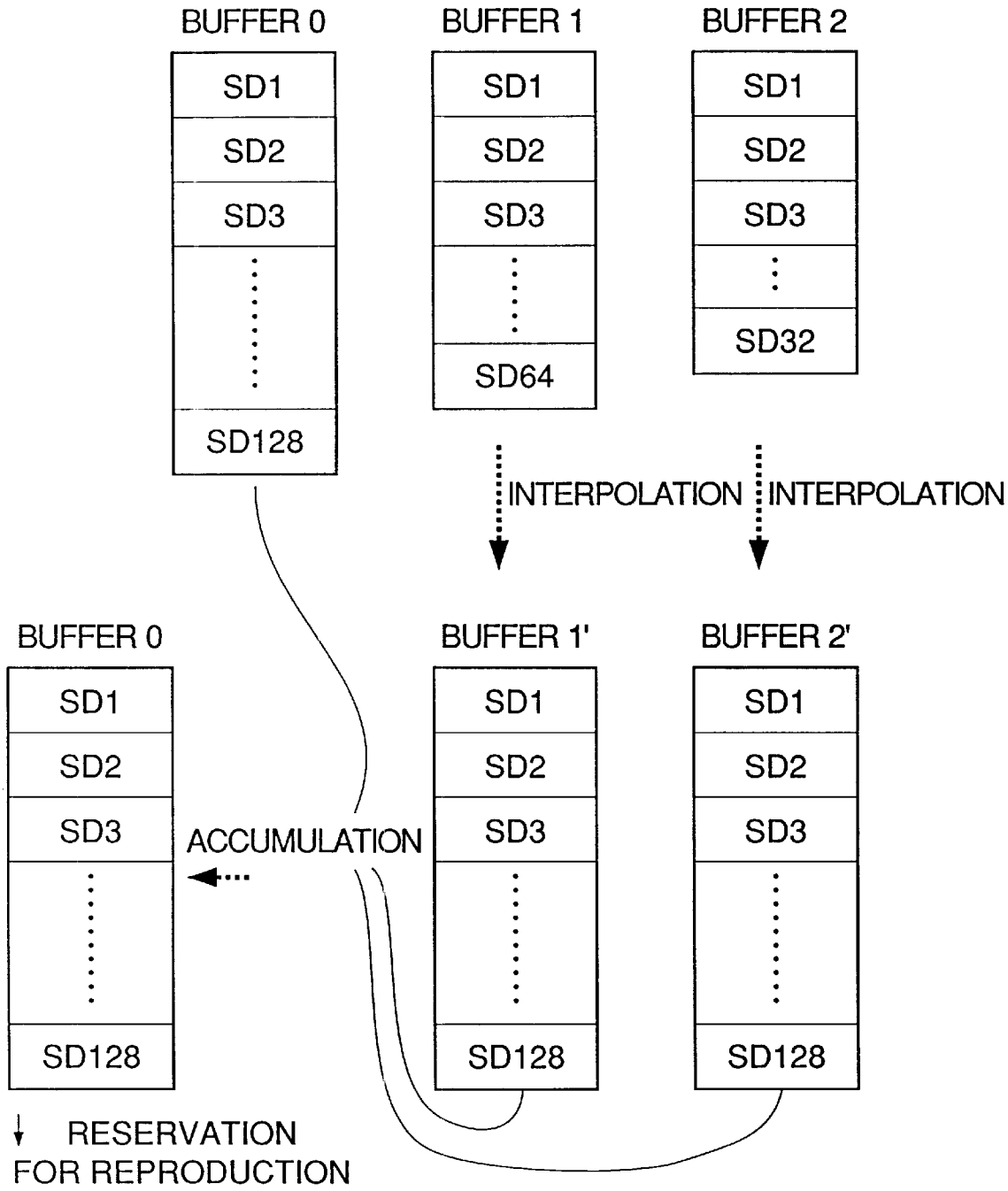
FIG. 3 shows formats of data stored in output buffers preset in the RAM.

FIG. 3 shows formats of output buffers preset on the RAM 6.

In the figure, a buffer 0 is for accumulating 128 musical tone waveform samples generated by a musical tone-generating channel to which is assigned the calculation mode 0 (CM(i)=0), one of the control data stored in the tone generator register, described hereinabove, a buffer 1 for accumulating 64 musical tone waveform samples generated by a tone generating channel to which the calculation mode 1 (CM(i)=1) is assigned, and a buffer 2 for accumulating 32 musical tone waveform samples generated by a tone generating channel to which the calculation mode 2 (CM(i)=2) is assigned.

A buffer 1' is for generating 128 musical tone waveform samples by interpolating the 64 musical tone waveform samples in the buffer 1, and a buffer 2' for generating 128 musical tone waveform samples by interpolating the 32 musical tone waveform samples in the buffer 2. The thus generated 128 musical tone waveform samples in the buffer 1' and those in the buffer 2' are accumulated together with the 128 musical tone waveform samples in the buffer 0 into 128 musical tone waveform samples, which are then stored in the buffer 0 for reproduction. That is, the buffer 0 also functions to store the 128 musical tone waveform sample data to be read by the DMA controller 9 for reproduction.

By thus interpolating musical tone waveform samples generated at such low sampling rates (waveform sample data in the buffers 1 and 2 in the present embodiment) into 128 musical tone waveform samples, the 128 musical tone waveform samples generated in the buffer 0 and the 64 and 32 musical tone waveform samples generated in the buffers 1 and 2 can be accumulated together without generating aliasing noise, whereby final 128 musical tone waveform samples for reproduction can be obtained. The interpolation method employed in the embodiment may be a well-known one, such as linear interpolation.

In the present embodiment, as state above, the three kinds of buffers 0 to 2 are provided and the buffer sizes thereof are set in the relationship of buffer 0:buffer 1: buffer 2=4:2:1. However, this setting is not limitative. Alternatively, for example, two types of buffers 0 and 1 may be provided, which have buffer sizes satisfying the relationship of buffer 0:buffer 1=3:1.

Now, an outline of the musical tone-generating processing executed by the musical tone-generating apparatus according to the present embodiment will be described with reference to FIGS. 4A, 4B and 4C.

For example, when a note-on event of a part p is input into the input buffer of FIG. 2C, tone color data PDp is designated according to the event, and then the waveform name WN(p) and the calculation mode CM(p) belonging to the designated data PDp are automatically designated, whereby the CPU 1 generates waveform samples of a musical tone corresponding to the input event at a time density (equivalent sampling frequency) determined by the calculation mode CM(p) on an output buffer corresponding to the calculation mode. Further, the CPU 1 executes a musical tone-generating calculation including interpolation on these waveform samples, stores the calculated data, i.e. musical tone waveform sample data, in the output buffer 0 of the RAM 6, and notifies the DMA controller 9 of the completion of the calculation (FIG. 4B). The DMA controller 9 sequentially reads the musical tone waveform sample data from the output buffer 0 (FIG. 4C). Performance data input through the MIDI interface 8 during a time period from the immediately preceding time point tBC of generation of a clock signal BC to the present time point tBC of generation of the clock signal BC is subjected to the present calculation for generating a musical tone. Reading and reproduction of the musical tone waveform sample data of which the calculation is completed at a time point tCE is executed by the DMA controller 9 starting at the next time point tBC of occurrence of the clock signal BC to generate a musical tone. Each arrow P shown in FIG. 4B simply indicates the correspondence between the calculated musical tone waveform sample data and the reading-reproducing processing, but does not indicate that the result of the calculation completed at the time point tCE is transferred at the time point tBC.

According to the present embodiment, the sampling frequency of the DAC 10 of the musical tone-generating apparatus is 48 kHz, and accordingly the clock signal BC is generated at time intervals of 2.7 msec (128/48k). Hence, the maximum delay time from inputting of performance data to actual generation of a musical tone is approximately 5 msec, which poses no listening problem on the human. For automatic performance, the delay time may be longer, and hence the size of the output buffer 0 may be made longer. Further, the reading-reproducing processing need not be started at the same timing as generation of the clock signal BC, but may be started at any timing such as at the lapse of a predetermined time period after the time point tBC of generation of the clock signal BC, insofar as it does not pose any listening problem on the human.

Now, description will be made of control processing executed by the CPU 1 of the musical tone-generating apparatus constructed as above, with reference to FIGS. 5 to 13.

Figure 5:
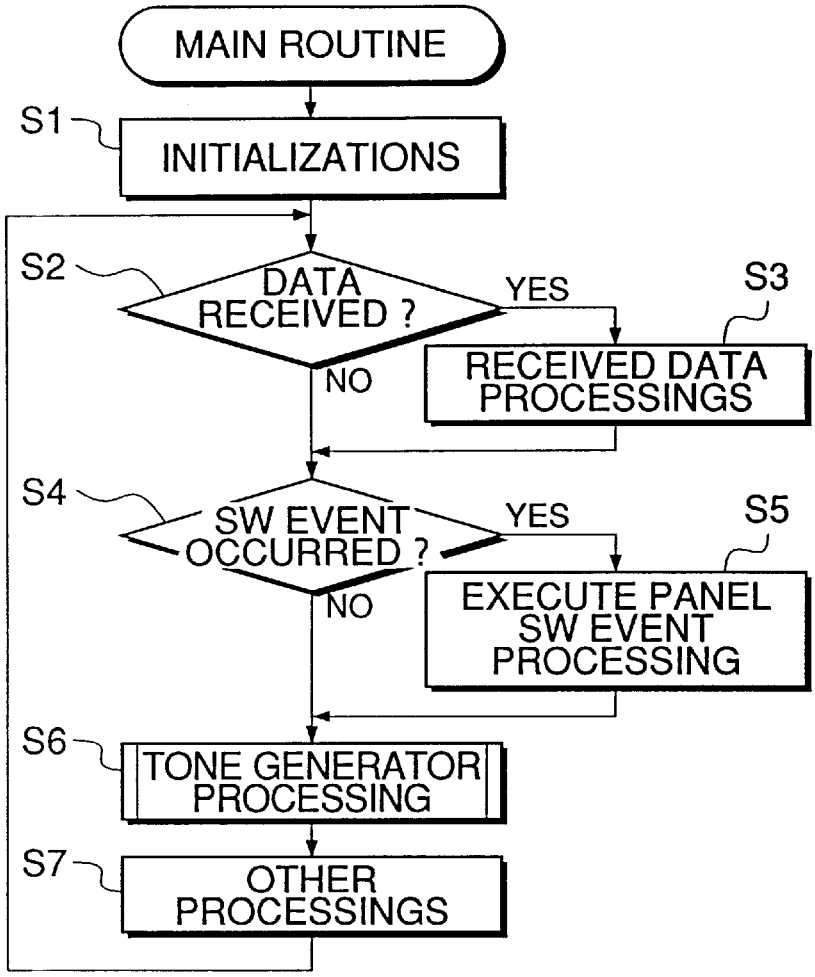
FIG. 5 is a flowchart showing a main routine executed by a CPU appearing in FIG. 1.
Figure 6:
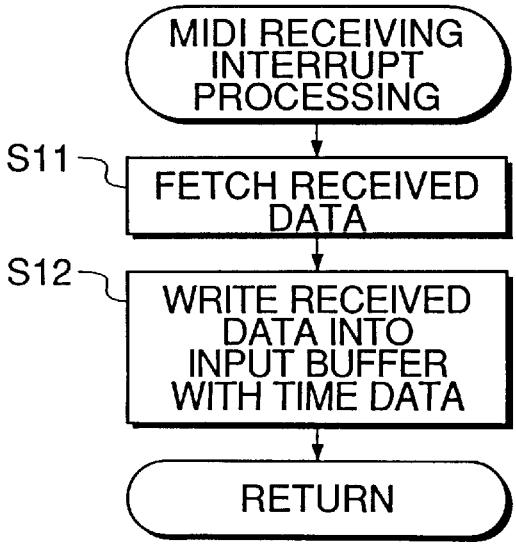
FIG. 6 is a flowchart showing MIDI-receiving interrupt, processing.

FIG. 5 shows a main routine executed by the CPU 1. The main routine is started when the user turns on a power source of the musical tone-generating apparatus (when the program of the software tone generator is triggered in the case where the invention is implemented on a general purpose personal computer). FIG. 6 shows MIDI-receiving interrupt processing. This interrupt processing is executed with the highest priority upon inputting of performance data through the MIDI interface 8.

First, the processing of FIG. 6 will be described. At a step S11, received data is fetched, and then at a step S12 the received data is written into the input buffer of the RAM 6 together with time data indicating when the data is received.

In the main routine of FIG. 5, first, initializations are executed at a step S1, i.e. all the tone-generating channels are turned off, all the registers are cleared, and the reading-reproducing processing by the DMA controller 9 is initialized to be started. Then, it is determined at a step S2 whether or not the input buffer contains received data. If the input buffer does not contain any received data, the program immediately proceeds to a step S4, whereas if the input buffer contains received data, operations corresponding to the received data, such as note-on event processing, note-off event processing and pedal processing are performed at a step S3, followed by the program proceeding to the step S4.

At the step S4, it is determined whether or not a switch event such as tone color selection has occurred. If no switch event has occurred, the program immediately proceeds to a step S6, whereas if a switch event has occurred, panel switch event processing is executed, e.g. by selecting a tone color for each MIDI channel according to setting of a tone color-selecting switch at a step S5, and then the program proceeds to a step S6.

At the step S6, a subroutine for tone generator processing shown in FIGS. 13A and 13B, hereinafter described, is executed, and further other processings are executed at a step S7, followed by the program returning to the step S2. Thereafter, the steps S2 to S7 are repeatedly executed.

Figure 7:
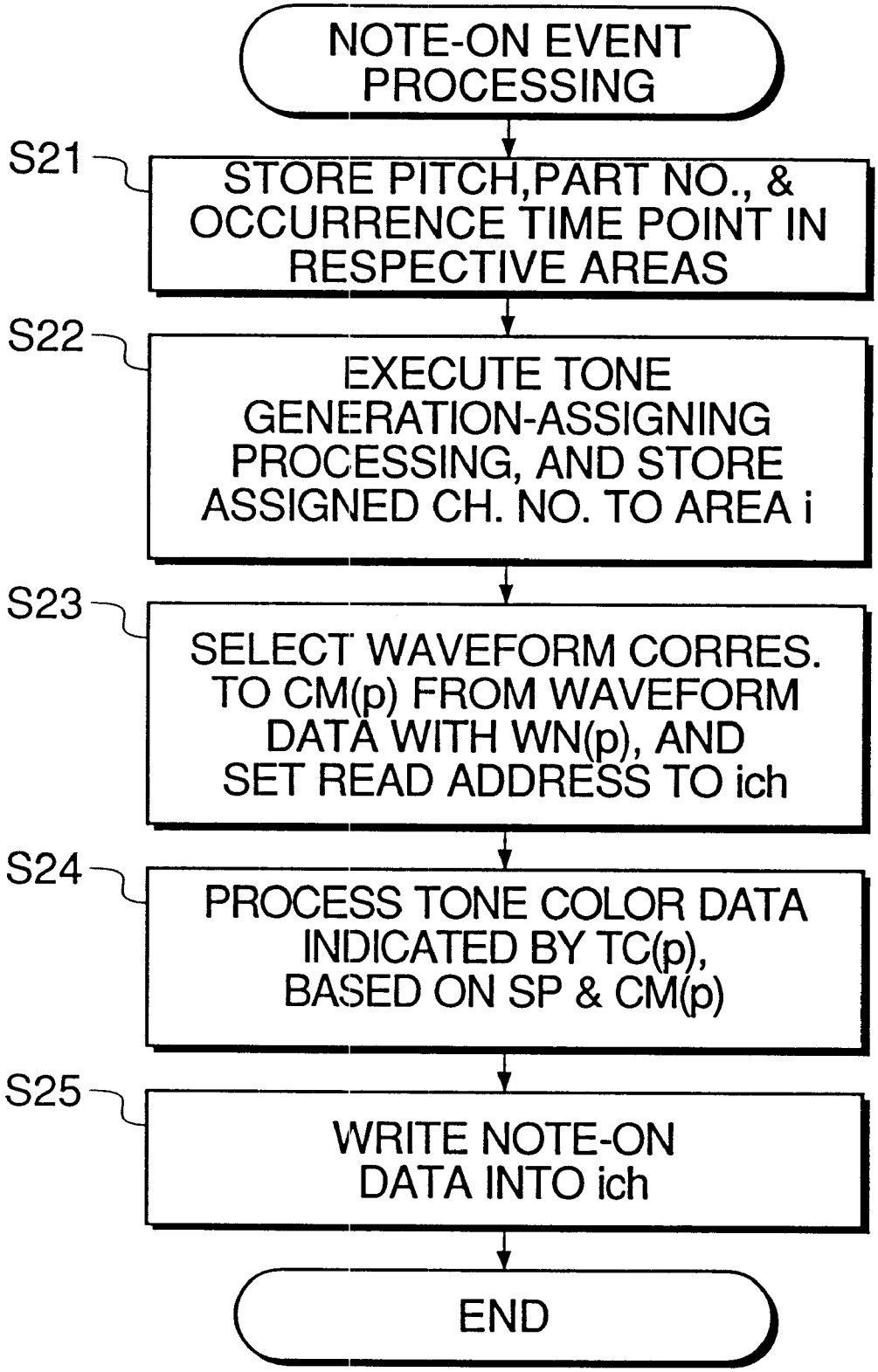
FIG. 7 is a flowchart showing note-on event processing executed when data is received through a MIDI interface appearing in FIG. 1.

FIG. 7 shows details of the note-on event processing which is one of the received data processings executed by the step S3 in FIG. 5.

First, at a step S21, a pitch and a part number indicated by the received note-on data are stored in an area SP (hereinafter the stored contents thereof will be referred to as "the pitch SP") and an area p (hereinafter the stored contents thereof will be referred to as "the part p") preset in the RAM 6, respectively, and at the same time an event occurrence time point (received time point) is stored in an area TM (hereinafter the contents thereof will be referred to as "the occurrence time point TM") preset in the RAM 6.

Then, at a step S22, tone generation-assigning processing is performed for determining a tone-generating channel of the tone generator register (FIG. 2D) into which tone color data is to be written, and the assigned channel number is stored in an area i (hereinafter the stored contents thereof will be referred to as "the assigned channel i").

At the following step S23, tone color data PDp for the part p (see FIG. 2A) is retrieved to obtain a waveform name (waveform-designating data) WN(p) and a calculation mode CM(p), and waveform data corresponding to the calculation mode CM(p) is selected out of waveform data having the waveform name WN(p), and a read address on the RAM 6 (see FIG. 2B) for reading out the waveform data is set as waveform-designating data for the assigned channel i (see FIG. 2D).

In this connection, a plurality of waveform data having the same waveform name WN(p) can be present. For example, the waveform data WD2' and WD2" are obtained by down-sampling the waveform data WD2 as mentioned before, and therefore have the same waveform name as that of the waveform data WD2. Thus, if a plurality of waveform data having the same waveform name are present, one of them is selected, which corresponds to the calculation mode CM(p).

However, even if a plurality of waveform data having the same waveform name are present, there is a case where no waveform data corresponding to the calculation mode CM(p) is present. For example, in FIG. 2B, no waveform data WD1" corresponding to the calculation mode CM(p) (p=2) is present. This is because the user did not prepare the waveform data WD1", e.g. by waveform LPF processing (described hereinafter with reference to FIG. 11). In such a case, waveform data corresponding to the calculation mode CM(p) cannot be selected, and therefore waveform data with the same waveform name WN(p) but corresponding to a different waveform mode WM is selected, and a desired musical tone signal is generated by changing the read speed for reading out the waveform data, i.e. by changing the pitch of the waveform data, specifically by adjusting the F number FN.

In the present embodiment, the calculation mode CM(p) and the waveform mode WM of a waveform suitable for musical tone generation in the calculation mode CM(p) are set in a one-to-one relationship. More specifically, if the calculation mode CM(p) is set to CM(p)=0, waveform data to which the waveform mode WM=0 is allotted is selected. However, the calculation mode CM(p) and the waveform mode WM are based on different concepts and do not always correspond to each other. The present embodiment is merely arranged such that waveform data are generated, of which the waveform mode WM corresponds to the calculation mode CM(p).

Referring again to FIG. 7, at a step S24, the tone color data PDp (tone color data indicated by a tone color number TC(p), hereinafter referred to) for the part p is processed according to the pitch SP and the calculation mode CM(p), and set in a predetermined area of the tone generator register of the assigned channel i together with the event occurrence time point TM. One of the objects of the processing of the tone color data PDp is to prevent the time changing shape of volume envelope generator (EG) control data for controlling a volume envelope generator, not shown, and the cut-off frequency of a tone color filter, not shown, from being changed according to the calculation mode C(p). Another object of the processing is, similarly to ordinary electronic musical instruments, to vary musical tone characteristics including the shape of the envelope, according to performance information such as the pitch SP. The tone color number TC(p) is set by the user, as will be described with reference to FIG. 8.

Next, note-on data is written into the tone generator register at the assigned channel i at a step S25, followed by terminating the present routine.

FIGS. 8 to 11 show routines for executing various event processings, which are triggered by depressing respective panel switches by the user. Each processing is one of the panel switch event processings executed at the step S5 in FIG. 5. The panel switches may be arranged in the keyboard 2, or alternatively they maybe displayed on the display 3. In the latter case, a cursor is moved by means of an up/down key of the keyboard 2 or a mouse, not shown, to depress a desired panel switch.

Figure 8:
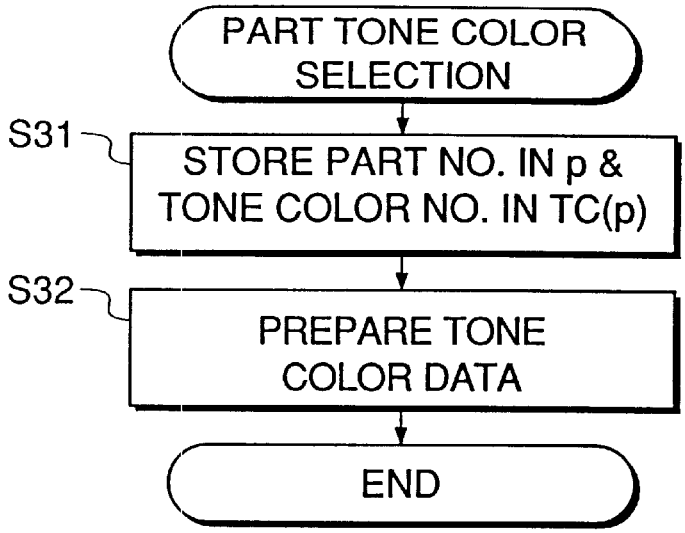
FIG. 8 is a flowchart showing part tone color-selecting processing executed when a part tone color-selecting switch is depressed.

FIG. 8 shows a routine for selecting a part tone color, which is executed when a part tone color-selecting switch of the panel switches, not shown, is depressed.

First, at a step S31, when the user inputs a part number, the part number is stored in the area p, and when the user inputs a tone color number, the tone color number is stored in an area TC(p) preset in the RAM 6. The tone color number stored in the area TC(p) is the above-mentioned tone color number TC(p).

Next, tone color data is prepared at a step S32. More specifically, tone color data indicated by the tone color number TC(p) is retrieved from a group of tone color data stored beforehand in a predetermined area within the hard disk of the HDD 4 and loaded into a tone color data area PDp indicated by the part p. Further, the waveform-designating data WN(p) in the loaded tone color data is referred to, and it is determined whether or not waveform data designated by the data WN(p) and the calculation mode CM(p) is present in the waveform data storage area of FIG. 2B. If the data is not present, the waveform data stored in the hard disk of the HDD 4 is read out and loaded into the waveform data storage area. On this occasion, tone color data previously set for the part p is saved in a corresponding storage area of the hard disk 4.

Figure 9:
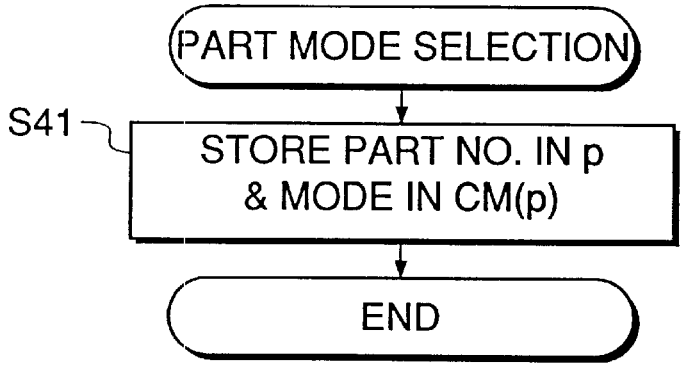
FIG. 9 is a flowchart showing part mode-selecting processing executed when a part mode-selecting switch is pressed.

FIG. 9 shows a routine for selecting a part mode, which is executed when a part mode-selecting switch, not shown, is depressed.

First, similarly to the step S31, a part number input by the user is stored in the area p, and when the user inputs a calculation mode, the calculation mode (an integer out of 0 to 2) is stored in the area CM(p) in the tone color data area indicated by the part p, at a step S41.

Figure 10:
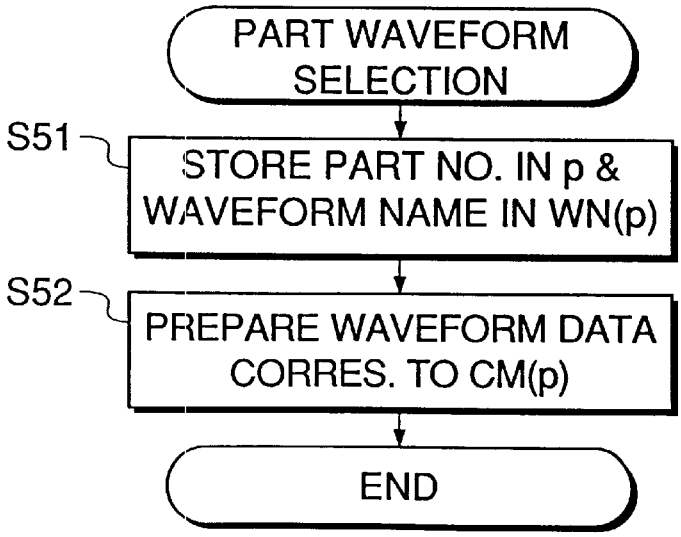
FIG. 10 is a flowchart showing part waveform-selecting processing executed when a waveform-selecting switch is depressed.

FIG. 10 shows a routine for selecting a part waveform, which is executed when a part waveform-selecting switch, not shown, is depressed.

First, similarly to the step S31, a part number input by the user is stored in the area p, and when the user inputs a waveform name, the waveform name is stored in the area WN(p) in the tone color data area indicated by the part p, at a step S51.

Next, waveform data corresponding to the calculation mode CM(p) is prepared at a step S52. More specifically, waveform data indicated by the waveform name WN(p) is retrieved from the group of waveform data stored in the predetermined area in the HDD 4 in a manner taking the calculation mode CM(p) into account, and the thus retrieved waveform data is loaded into the waveform data area in the RAM 6 (see FIG. 2B).

The expression in a manner taking the calculation mode CM(p) into account" means as follows: If a plurality of waveform data with the same waveform name WN(p) are present, which include waveform data to which is allotted the waveform mode WM corresponding to the calculation mode CM(p), only the waveform data with the waveform mode WM allotted thereto is selected and loaded into the waveform data area. In this manner, the RAM 6 can be efficiently used. Alternatively, all the waveform data having the same waveform name WN(p) may be loaded into the waveform data area irrespective of the calculation mode CM(p).

If waveform data with the same waveform name has already been stored in the waveform data area in the RAM 6, the present processing need not be executed, but re-loading of the waveform data does not pose any problem.

Figure 11:
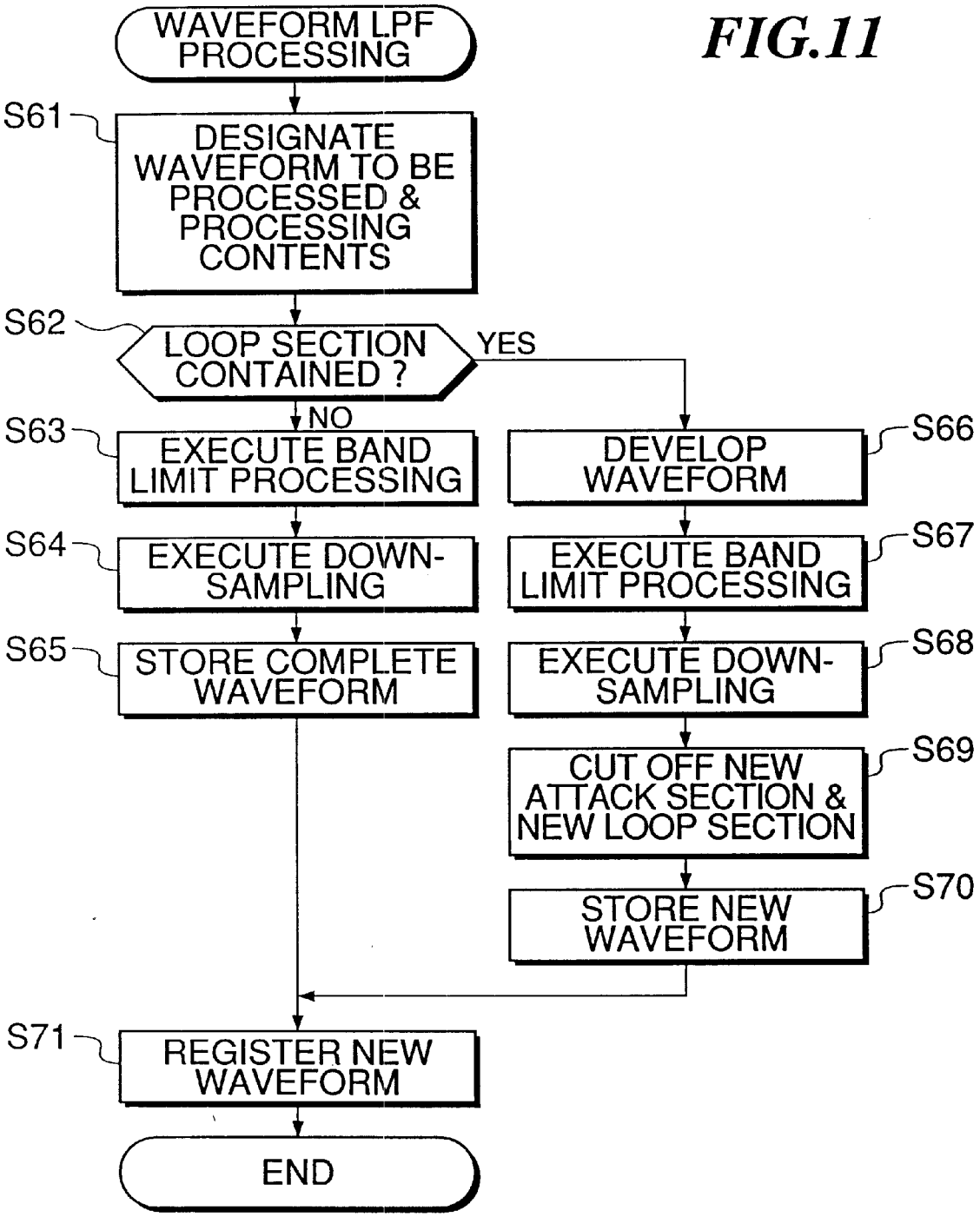
FIG. 11 is a flowchart showing waveform LPF processing executed when a waveform LPF switch is depressed.

FIG. 11 shows a routine for carrying out waveform LPF processing, which is executed when a waveform LPF switch, not shown, is depressed.

First, when the user inputs a waveform to be processed and contents of processing for the waveform, the waveform data to be processed is retrieved from the waveform data area of the RAM 6 at a step S61. If the waveform data to be processed cannot be retrieved, it is retrieved from the group of waveform data stored in the hard disk 4. The contents of the processing include kinds of down-sampling and a frequency band to be limited.

Then, it is determined at a step S62 whether or not the waveform data thus retrieved contains a loop section to be repeatedly read out. If the waveform data does not contain any loop section, band limiting processing is executed at a step S63. Then, down-sampling is executed at a step S64 to complete the waveform, followed by storing the thus completed waveform in the waveform data area in the RAM 6 at a step S65. The band limiting processing is employed in order to prevent mixing of aliasing noises in the stored waveform data, which will occur if down-sampling is executed to store the waveform data as it is without execution of the band limiting processing. Therefore, band limiting processing should be effected to such an extent as avoid occurrence of aliasing noises by the down-sampling. A frequency band to be limited is set by the user at the step S61.

Figure 12A:
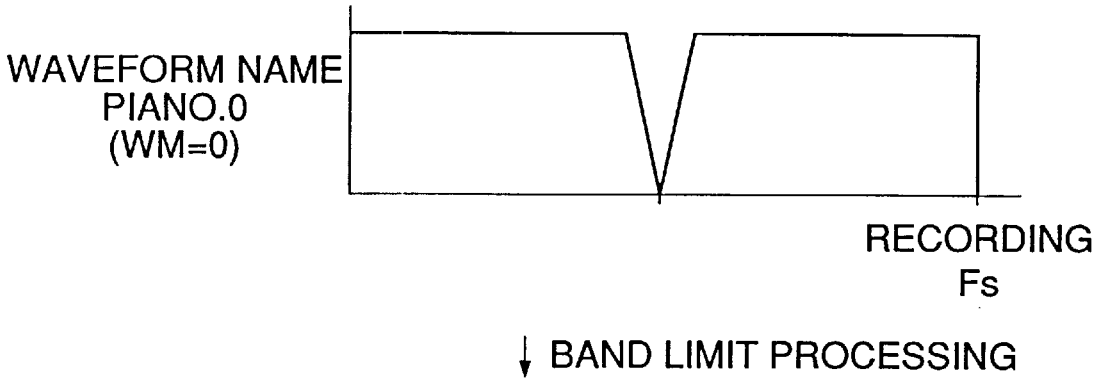
Figure 12B:
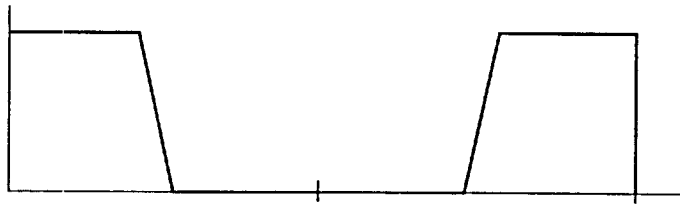
Figure 12B:
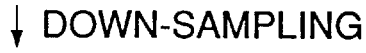
Figure 12C:
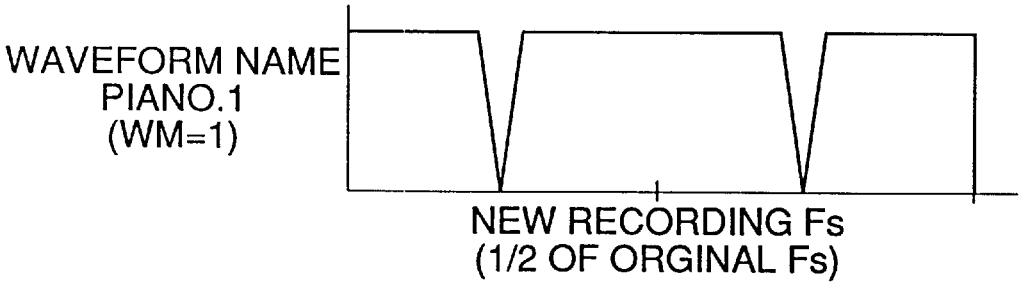
Figure 12C:
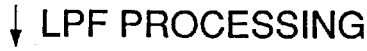
Figure 12D:
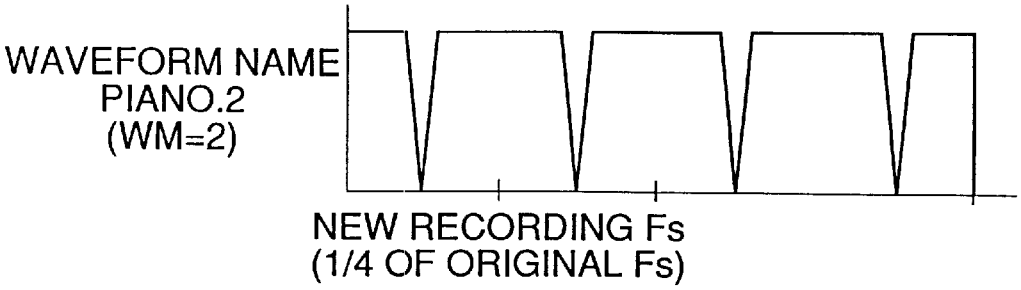

Referring next to FIGS. 12A to 12D, the processings at the steps S63 and S64 will be explained. In the figures, the abscissa represents the frequency, and the ordinate the level. FIG. 12A shows an example of frequency spectrum of a waveform (waveform name: PIANO. 0) before the waveform LPF processing, i.e. a frequency spectrum of an original waveform which has been sampled at a predetermined recording sampling frequency Fs for calculating musical tone waveform data at the equivalent sampling frequency of 48 kHz (waveform mode WM=0). FIG. 12B shows a frequency spectrum of a waveform obtained after subjecting the waveform of FIG. 12A to band limiting processing. FIG. 12C shows a frequency spectrum of a waveform which is obtained by down-sampling the waveform of FIG. 12B at a frequency ½ times of the original recording sampling frequency, for calculating musical tone waveform data at the equivalent sampling frequency of 24 kHz (waveform mode WM=1). FIG. 12D shows a frequency spectrum of a waveform obtained by subjecting the waveform of FIG. 12C to the waveform LPF processing, i.e. band limiting processing, and then down-sampling the resulting waveform data at a frequency ½ times of the recording sampling frequency, for calculating musical tone waveform data at the equivalent sampling frequency of 12 kHz (waveform mode WM=2). The down-sampling in FIG. 12C is, as described hereinabove with reference to FIG. 12B, executed by skipping every other sample of the waveform data of FIG. 12B. Similarly, the down-sampling in FIG. 12D is executed by skipping every other sample of the waveform data of FIG. 12C after execution of the band limiting processing. Therefore, according to the present embodiment, the down-sampling can be effected only at a frequency which is $2^{-n}$ times (n: a positive integer) of the recording sampling frequency of the original waveform. However, by simultaneously executing the processings at the steps S63 and S64, it is possible to perform the down-sampling at a frequency which is an arbitrary multiple of the sampling frequency of the original waveform.

Referring again to FIG. 11, if it is determined at the step S62 that the retrieved waveform data has a loop section, the waveform is developed into a waveform having an attack section and several repetitions of the loop section connected to the attack section, at a step S66. Then, the developed waveform data is subjected to a band limit processing at a step S67, followed by down-sampling the band-limited data at a step S68. Then, a new attack section and a new loop section are separately cut off from the thus generated waveform data at a step S69, and a waveform is completed from the waveform data and stored at a step S70, similarly to the step S65. The processings at the steps S67 and S68 are the same as those at the steps S63 and 64. The reason why the waveform having a loop section is subjected to the above processing is as follows: In waveform data which has an attack section and a loop section, the loop section is formed by a small number of samples, and therefore a high-order low pass filter cannot be used to directly subject the original waveform to the band-limiting processing, whereby a satisfactory band attenuation characteristic cannot be obtained. The above described processing method enables the use of a high-order low pass filter even for waveform data having a loop section, to thereby achieve LPF processing with reduced noises.

Figure 13A:
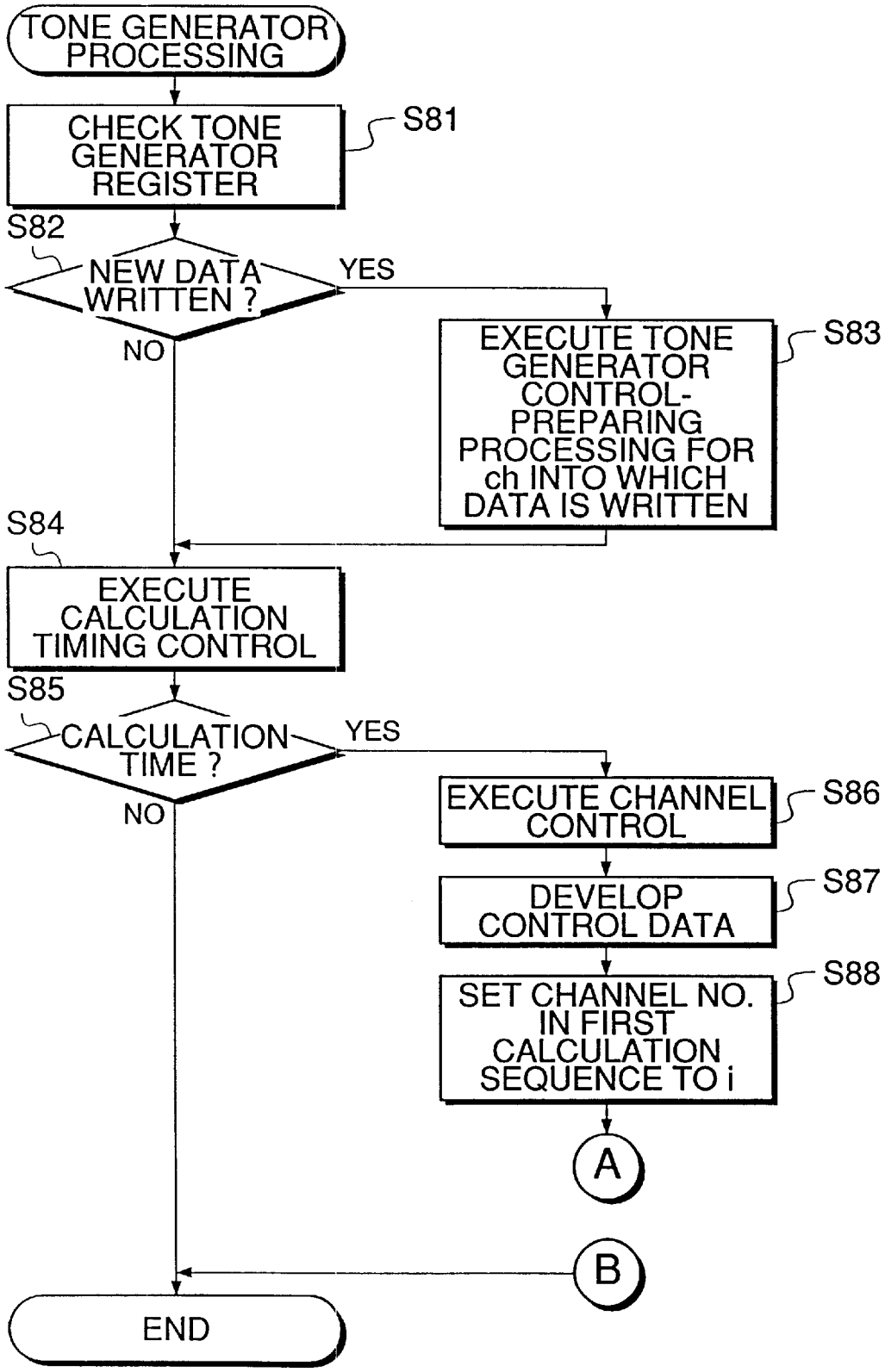
FIG. 13A is a flowchart showing tone generator processing which is executed at a step S6 in FIG. 5.
Figure 13B:
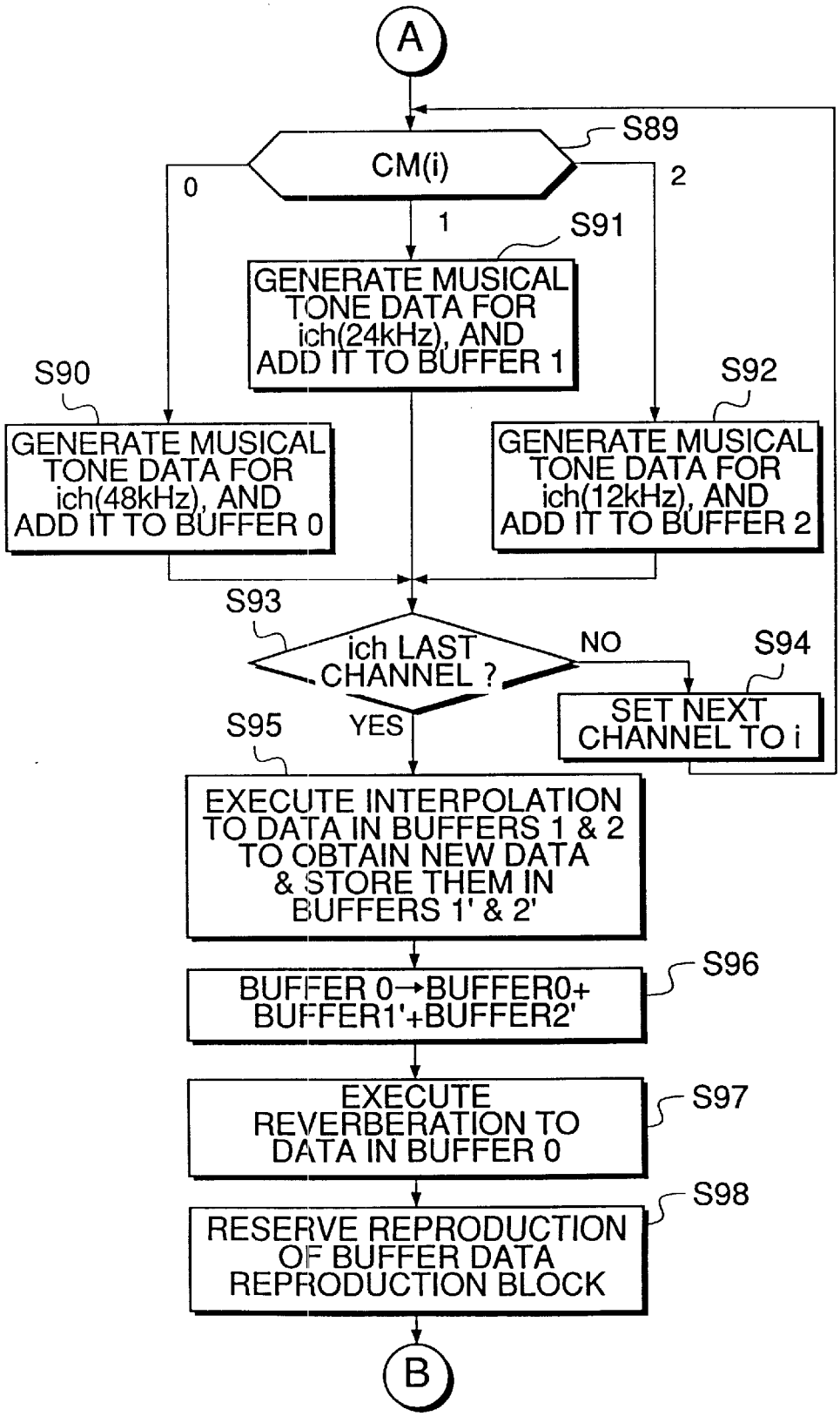
FIG. 13B is a continued part of the FIG. 13A flowchart.

FIGS. 13A and 13B show details of the tone generator processing executed at the step S6 in FIG. 5.

First, at a step S81 in FIG. 13A, the contents in the tone generator register (FIG. 2D) are checked to determine whether or not new data has been written into the register, at a step S82. If no new data has been written, the program immediately proceeds to a step S84. On the other hand, if new data has been written, tone generator control-preparing processing for a tone-generating channel into which the new data has been written is executed at a step S83. More specifically, the tone generator control-preparing processing includes converting data in a tone-generating channel i (into which data has been newly written) into various control data for actual waveform calculation, and setting the first read address for reading out waveform data corresponding to the data in the channel i.

At the following step S84, calculation timing control is carried out. Specifically, a timing for starting reading of waveform data currently under reproduction is set to a time point tBC (FIG. 4) for starting calculation of waveform data to be reproduced next time in such a manner that waveform data are continuously read and reproduced without interruption at the reproduction block (DMA controller 9). At the following step S85, it is determined whether or not the calculation-starting time point tBC has been reached, and if not, the program is immediately terminated.

When the calculation-starting time point has been reached, channel control is first carried out to determine a sequence of calculations and a channel to be stopped from generating a musical tone, according to musical tones to be produced by respective channels (step S86). The calculation sequence is determined in order to carry out calculation for channels for generating musical tones of higher degrees of importance earlier in case that all the calculations cannot be completed by the time they should be completed (i.e. the calculations are stopped immediately when the time is reached). Then, the data prepared at the step S83 are developed on the time axis to prepare for waveform calculations (step S87). Then, at a step S88, the number of a tone-generating channel having the first calculation order is set to the parameter i.

At a step S89 in FIG. 13B, the value of the calculation mode CM(i) is determined, and if CM(i)=0 holds, musical tone waveform data for 128 samples for the channel i is generated and added to data in the buffer 0 at a step S90. If CM(i)=1 holds, musical tone waveform data for 64 samples for the channel i is generated and added to data in the buffer 1 at a step S91. If CM(i)=2 holds, musical tone waveform data for 32 samples for the channel i is generated and added to data in the buffer 2 at a step S92. The processings at the steps S90 to S92 each are not a simple addition of musical tone data to the data in the corresponding buffer. Specifically, the addition is effected after execution of control of updating a read address corresponding to the F number FN for each channel i (see FIG. 2D), reading and interpolation of waveform sample data corresponding to the read address, read out from the waveform data storage area shown in FIG. 2B, and then tone color and volume envelope processing of the interpolated waveform samples to obtain musical tone waveform samples. The above described processings are repeatedly performed for each sample of the musical tone waveform data generated by one generation processing. For example, for the channel i having the calculation mode CM(i)=0, the above processings are repeatedly performed until 128 musical tone waveform samples are obtained. The waveform data which is read out is waveform data designated by the waveform-designating data. The waveform data is selected and designated according to the waveform name WN(p) of the part p to which a musical tone being generated through the tone-generating channel i belongs, and the calculation mode CM(i). If the recording sampling frequency of the waveform data used for a currently generated musical tone signal does not correspond to the calculation mode (equivalent sampling frequency) set for the channel i, the F number FN value is corrected by the latter term of the equation (1) for calculating the F number FN. This correction is made in order to ensure generation of a musical tone at the designated pitch. For details of the processing at the steps S90 to 92, reference should be made to the specification and FIG. 13 of Japanese Patent Application No. 7-197923 filed Jul. 12, 1995 (corresponding to U.S. patent application filed Jul. 11, 1996).

As described hereinabove, even if waveform with a waveform mode which is suitable for the designated calculation mode is not selected, it is possible to generate musical tone waveform samples at the designated pitch SP in any calculation mode, by correcting the F number FN. However, if the F number FN assumes a value largely different from a reference value "1" thereof due to the correction, etc., the resulting generated musical tone can have a degraded quality. For example, when the F number FN for the channel is corrected to a very large value due to the correction (e.g. FN>2), high frequency band components of waveform data read out from the waveform data storage area exceeds half of the equivalent sampling frequency, causing generation of aliasing noises in waveform samples obtained by the interpolation. Conversely, if the F number FN is corrected to a very small value due to the correction (e g. FN<0.5), waveform samples obtained by interpolation contain only higher harmonic frequency components lower than ¼ times of the equivalent sampling frequency, failing to obtain a quality corresponding to the time density set for the channel for generating musical tone waveform samples. Therefore, in designating waveform data by waveform-designating data to be read out for generating musical tones through each channel i, it is desirable to select waveform data with a waveform mode allotted thereto, which is suitable for the calculation mode CM (i) for the each channel, e.g. waveform data with WM=1 if CM=1.

Referring again to FIG. 13B, it is determined at a step S93 whether or not the current channel i is the last channel, i.e. whether or not calculations of waveforms for all the channels required for generating musical tones have been completed. If waveform for any channel or channels remains to be calculated, the number of the channel to be calculated next time is set to the channel i at a step S94, followed by the program returning to the step S89, to thereby repeatedly execute the processing. On the other hand, if waveform calculations have been completed for all the channels, the program proceeds to a step S95.

At the step S95, as previously described with reference to FIG. 3, 64 musical tone waveform samples generated in the buffer 1 and 32 musical tone waveform samples generated in the buffer 2 are interpolated (oversampled), and respective 128 musical tone waveform data samples thus obtained are stored in the buffers 1' and 2' as musical tone waveform data. Then, at a step S96, 128 musical tone waveform samples obtained by adding together respective 128 musical tone waveform samples in the buffers 0, 1' and 2' are stored in the buffer 0.

At the following step S97, the musical tone waveform data thus stored in the buffer 0 is subjected to reverberation processing to impart a reverberation effect to the data, and then at a step S98, reproduction of the 128 musical tone waveform samples in the buffer 0 is reserved with the reproduction area, followed by terminating the present tone generator processing.

As described hereinabove, according to the present embodiment, a plurality of calculation modes are provided for calculating musical tone waveform data to generate musical tones, and the user can freely select a desired calculation mode, and therefore the user can select either a mode in which an increased number of musical tone are generated or a mode in which musical tones are generated with a high quality, depending on the purpose of use of musical tone generation.

Further, since the calculation mode can be set for each part, musical tones for the part having a larger listening effect can be generated with a high quality, to thereby enable making the most of the limited processing capacity of the musical tone-generating apparatus.

Furthermore, waveform data with a low recording sampling frequency for a calculation mode (mode 1 or 2) for generating musical tones with a low quality can be prepared by LPF processing from waveform data with a high recording sampling frequency for a calculation mode (mode 0) for generating musical tones with a high quality. Further, waveform data can be selected out of the thus generated waveform data according to the calculation mode selected by the user, to thereby generate musical tones. As a result, for example, when musical tones are generated through a channel where calculation is made at a low equivalent sampling frequency, a waveform having the same tone color as that of a musical tone calculated at a high equivalent sampling frequency can be generated without generating aliasing noises though it has a slightly degraded quality.

Still further, waveform data is automatically selected according to the calculation mode selected by the user, and therefore in a channel for generating musical tones at a high equivalent sampling frequency, waveform data with a high recording sampling frequency and having frequency components over a broad band can be processed, while in a channel for generating musical tones at a low equivalent sampling frequency, waveform data with a low recording sampling frequency and having frequency components over a narrow band can be processed. This makes it unnecessary to change designation of a waveform in the tone color data.

According to the present embodiment, when a calculation mode CM(p) for calculating a smaller number of samples is selected, if no waveform data having the waveform mode WM corresponding to the selected calculation mode CM(p) is present, waveform data with a waveform mode WM corresponding to a calculation mode CM(p) different from the selected one is selected to generate a musical tone signal based on the selected waveform data. However, this is not limitative. It may be so arranged that it is automatically detected whether or not waveform data with a waveform mode corresponding to the selected calculation mode CM(p) is present, and if no data is present, the waveform LPF processing of FIG. 11 is automatically executed to prepare waveform data with a waveform mode corresponding to the selected calculation mode CM(p), whereby a musical tone signal is generated based on the thus prepared waveform data.

Further, according to the present embodiment, the waveform data WDn (n=1, 2, . . . ) is subjected to the waveform LPF processing, to thereby obtain waveform data WDn' and WDn' with lower recording sampling frequencies, but this is not limitative. The waveform data WDn may be subjected to a processing other than the waveform LPF processing. For example, musical tones may be first recorded at low recording sampling frequencies to directly obtain waveform data WDn' and WDn". Further, not only the waveform data WDn but also the waveform data WDn' and WDn" can be stored in the hard disk 4. Then, the waveform data WDn' and WDn" can be directly read out from the hard disk 4 into the RAM 6 without executing the waveform LPF processing.

Although only one calculation mode CM(p) can be selected for each part according to the embodiment, this is not limitative. Alternatively, the calculation mode may be automatically changed over a plurality of channels which generate musical tones for the same part, according to the volume, pitch, etc. set for each channel.

Next, a second embodiment of the invention will be described hereinbelow. The second embodiment employs hardware (FIG. 1) and basic musical tone-generating processing (FIG. 4) substantially identical with those of the first embodiment, except that the contents of control processing executed by the CPU 1 and formats of musical tone control data used therefor are different from those in the first embodiment.

FIGS. 14A to 14E show formats of tone color data and waveform data stored in the RAM 6 and data stored in the input buffer and the tone generator register preset on the RAM 6.

Figure 14A:
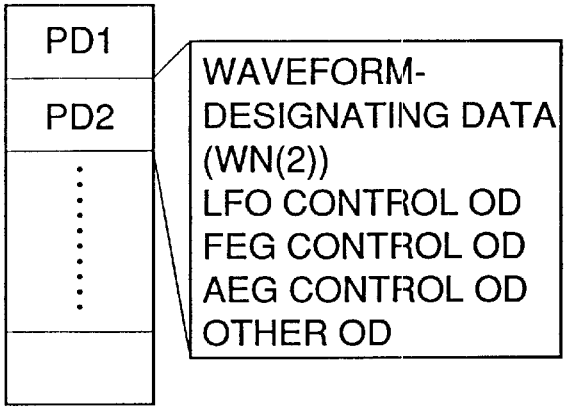

Referring first to FIG. 14A, there is shown a format of the tone color data register in which tone color data from which a calculation mode CM(p), described with reference to FIG. 2A, is omitted, are stored.

Figure 14B:
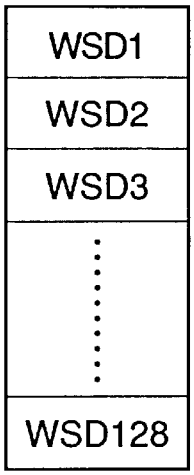
Figure 14E:
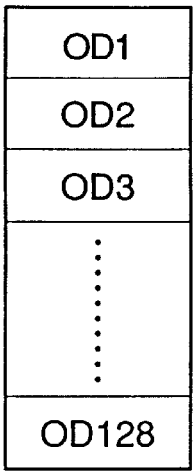
FIG. 14E shows a format of data stored in an output buffer stored in the RAM.

FIG. 14B shows a format of a sample buffer WB. FIG. 14E shows a format of a sample buffer OB which corresponds to the buffer 0 in FIG. 3.

The buffers WB and OB are each provided with a waveform data storage area for 128 musical tone waveform samples (WSD1 to WSD128 and OD1 to OD128, respectively. The output buffer OB stores waveform data obtained by sequentially adding together musical tone waveform data for 32 tone-generating channels. A calculation of waveform data is carried out by calculating 128 samples for reproduction over a time period corresponding to one frame for each channel, and repeating the same calculation for the maximum 32 channels (i.e. channels currently used for sounding).

The sample buffer WB stores waveform data for one channel, and the output buffer OB accumulates new waveform data for one channel to the waveform data already stored therein, whenever the new waveform data for one channel is calculated. In this connection, the time period corresponding to one frame is equal to a time interval between adjacent clock occurrence time points shown in FIG. 4C according to the first embodiment.

Figure 14C:
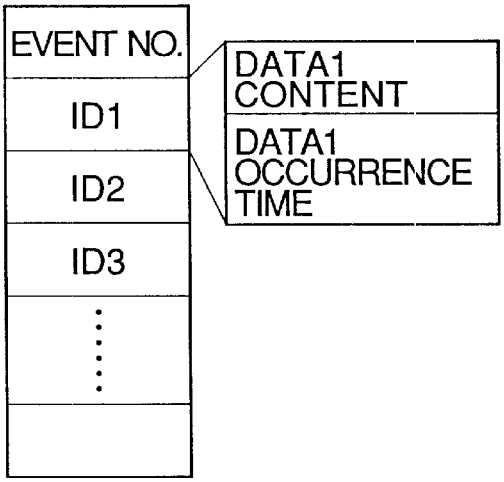

FIG. 14C shows a format of the input buffer, which is identical with the format of the input buffer in FIG. 2C, description of which is omitted.

Figure 14D:
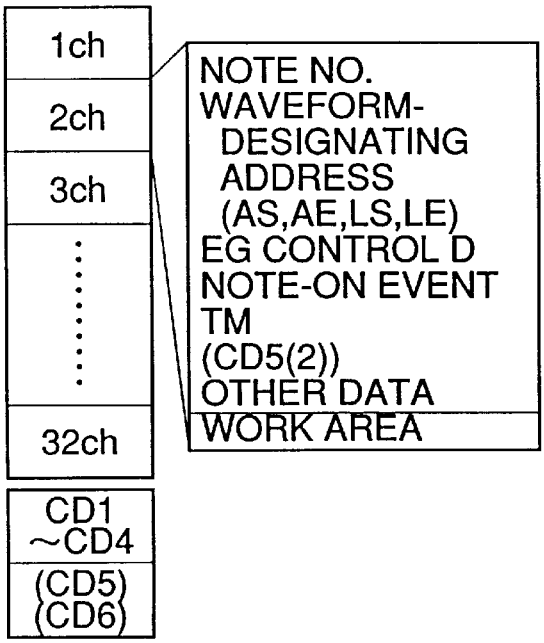

FIG. 14D shows a format of the tone generator register which corresponds to the tone generator register of FIG. 2D in the first embodiment. The tone generator register of FIG. 14D is different from the tone generator register of FIG. 2D in that it stores a note number in place of the pitch PS and the F number FN in FIG. 2D, has omitted therefrom the area for the calculation mode CM(p) in FIG. 2D, and contains an area for storing data CD1 to CD6, referred to hereinafter. Except for these, the tone generator register of the present embodiment is identical with that of the first embodiment, and therefore description thereof is omitted.

Figure 15:
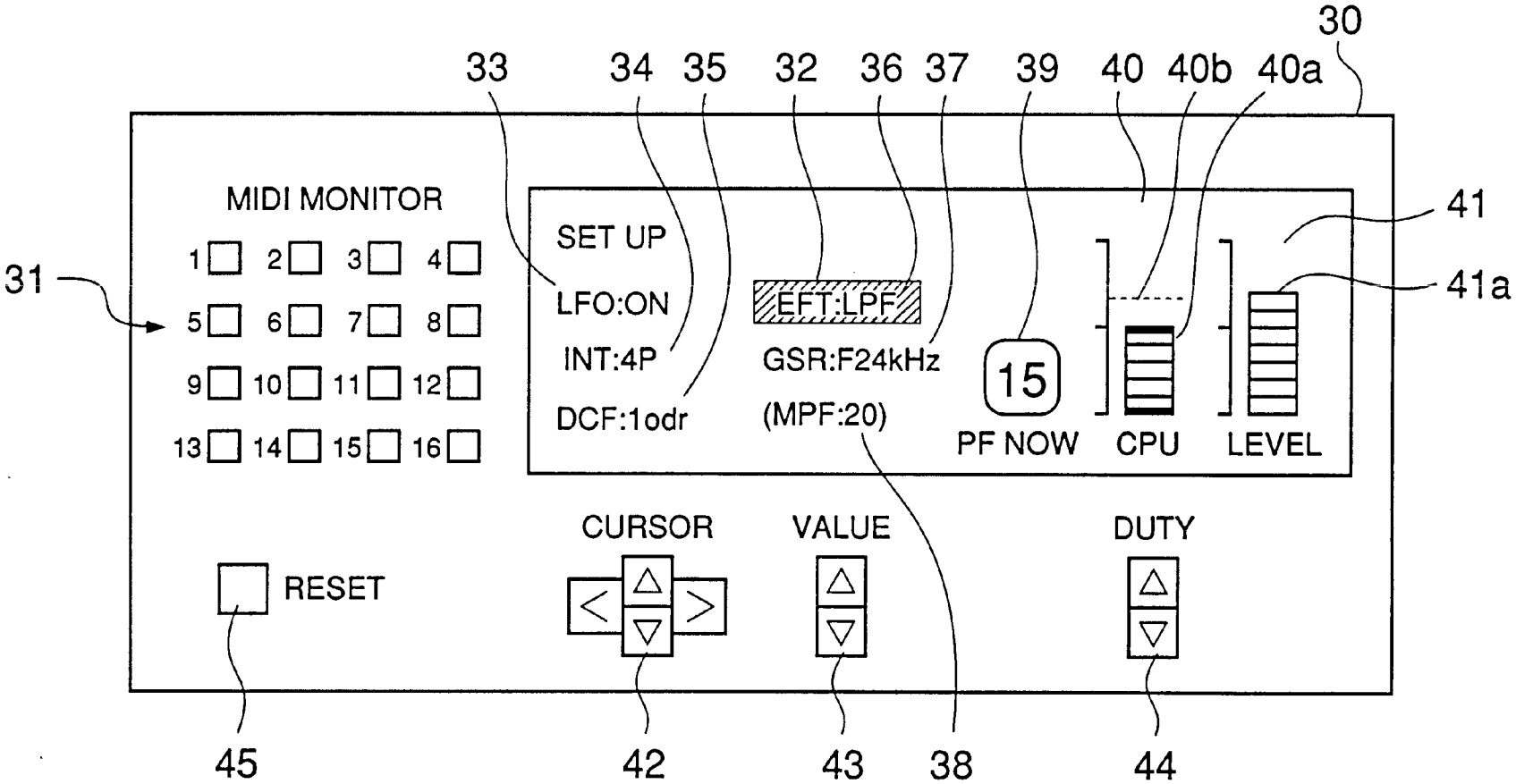
FIG. 15 is a diagram showing an example of the arrangement of a control panel surface displayed on a display of the musical tone-generating apparatus according to the second embodiment.

FIG. 15 shows an example of the arrangement of a control panel view displayed on the display 3 when a main routine of FIG. 16, referred to hereinafter, is triggered. The view is displayed on part of the display screen of the display 3 in a so-called window format. In the control panel view, various display sections are arranged, including a MIDI monitor 31, an LFO on/off display section 33, an interpolation (INT)-setting display section 34, a digital filter (DCF)-setting display section 35, an effect (EFT)-setting display section 36, a sampling frequency (GSR)-setting display section 37, a maximum tone-generating channel number (MPF)-setting display section 38, a currently sounded channel number display section 39, a duty ratio display section 40, and a sound level display section 41. Further, various key switches are arranged, including a cursor (CURSOR) key 42, a value (VALUE) switch 43, a duty ratio (DUTY) switch 44, and a reset (RESET) switch 45. A portion 32 with shaded background indicates that the cursor is placed thereon.

The MIDI monitor 31 lights up a lamp corresponding to a MIDI channel which has received or delivered data. An LFO (low frequency oscillator) which is displayed by the LFO on/off display section 33 imparts a wavy effect like vibrato to a musical tone to be generated. On/off switching of the LFO can be carried out by moving the cursor 32 on the display section 33 by means of the cursor key 42 and operating the value switch 43. Functions displayed by the other display sections 34 to 38 can be switched on or off in the same manner as above.

The interpolation-setting display section 34 displays which interpolation method has been selected. More specifically, when the sampling frequency of waveform data in a waveform table (corresponding to the waveform data storage area of FIG. 2B in the first embodiment) in the RAM 6 is shifted according to the sampling frequency of a musical tone to be generated, a read address for reading out the waveform data can have a fraction part. The interpolation-setting display section 34 selects a suitable interpolation method for obtaining a sample corresponding to the fraction part. The interpolation-setting display section 34 can select a four-point interpolation method using a cubic function, a two-point interpolation method using a linear function, and no use of interpolation method which is selected for musical tones requiring no frequency shifting, such as percussion instrument tones.

The digital filter-setting display section 35 selects as a digital filter, a single-order filter, a dual-order filter, or no use of tone color filter.

The effect setting display section 36 turns on/off the effect of reverberation or a low pass filter (LPF).

The above-mentioned setting display sections set the contents of the tone generator processing executed by the CPU 1.

Further, the sampling frequency-setting display section 37 is concerned with a third embodiment of the invention, described hereinafter with reference to FIGS. 22A and 22B, which changes the equivalent sampling frequency (normally 48 kHz) at which musical tone waveform data is calculated by the software tone generator when it is to be set to a lower frequency. According to the embodiment, the sampling frequency can be set to 24 kHz and 12 kHz in addition to 48 kHz.

The maximum tone-generating channel number-setting display section 38 is concerned with a fourth embodiment of the invention, referred to hereinafter, and displays the maximum number of tone-generating channels to be used for tone generation by the software tone generator which can simultaneously generate 32 musical tones at the maximum, when the maximum number of musical tones to be generated at the same time is limited below 32 in order to reduce the burden on the CPU 1. The maximum number of tone-generating channels that can be used for tone generation can be changed within a range of 1 to 32 by changing the numerical value which is displayed by the maximum tone-generating channel number-setting display section 38.

The currently sounded musical channel number display section 39 displays the number of tone-generating channels currently used for tone generation, i.e. the number of musical tones currently generated by the software tone generator.

The duty ratio display section 40 displays the ratio of capacity occupied by the software tone generator to the whole capacity of the CPU 1. The capacity is displayed in a bar chart 40*a*. Further, by operating the duty ratio switch 44, the upper limit DR of the duty ratio of the capacity of the CPU 1, which the software tone generator can occupy, can be set, and the thus set upper limit of the duty ratio is displayed on the duty ratio display section 40 in a dotted line 40*b*.

The tone generation level display section 41 displays the sound level of a currently generated musical tone signal in a bar chart 41*a*.

Next, control processing executed by the musical tone-generating apparatus according to the second embodiment will be described with reference to FIGS. 16 to 20.

Figure 16:
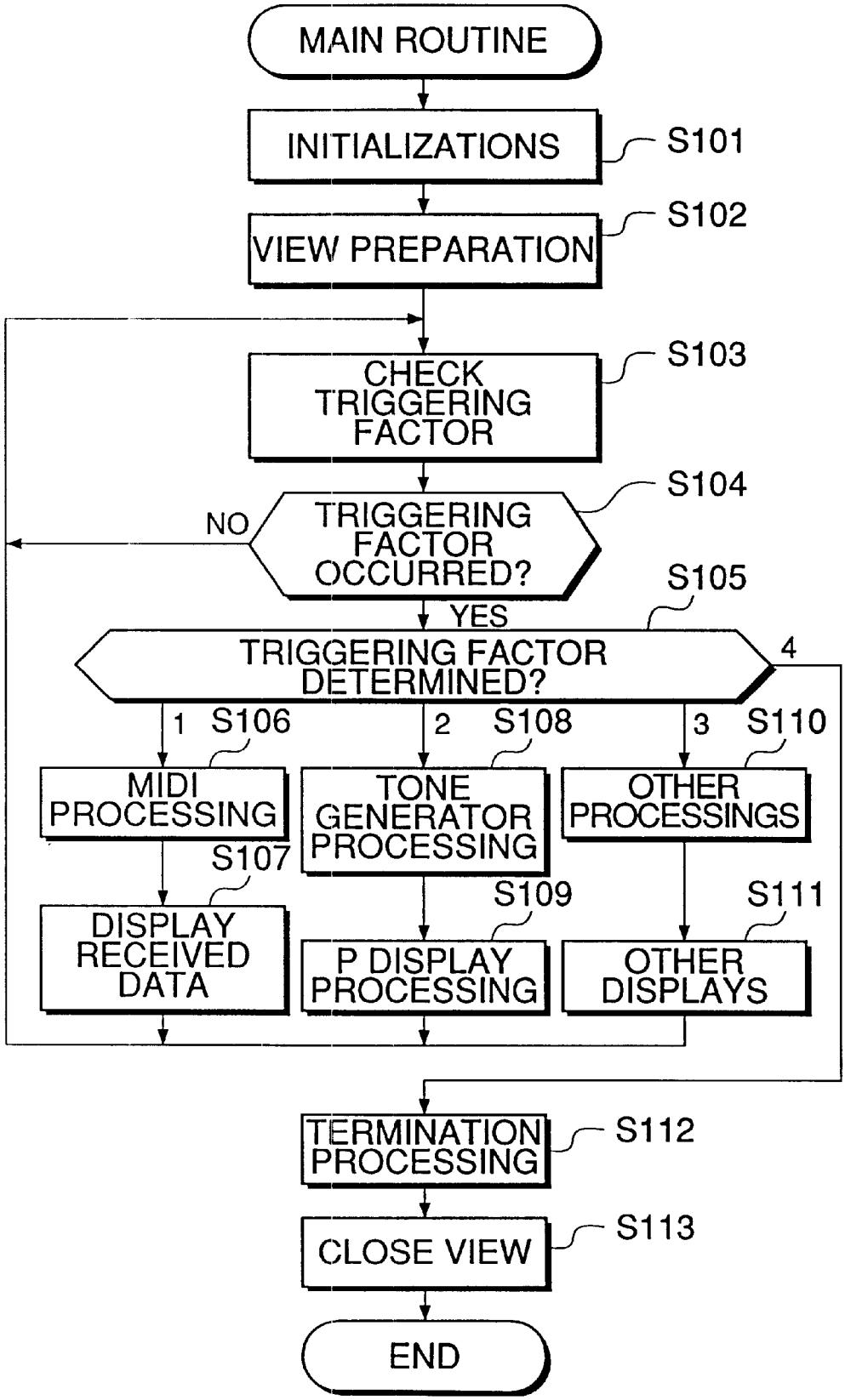
FIG. 16 is a flowchart showing a main routine executed by a CPU of the musical tone-generating apparatus according to the second embodiment.
Figure 18A:
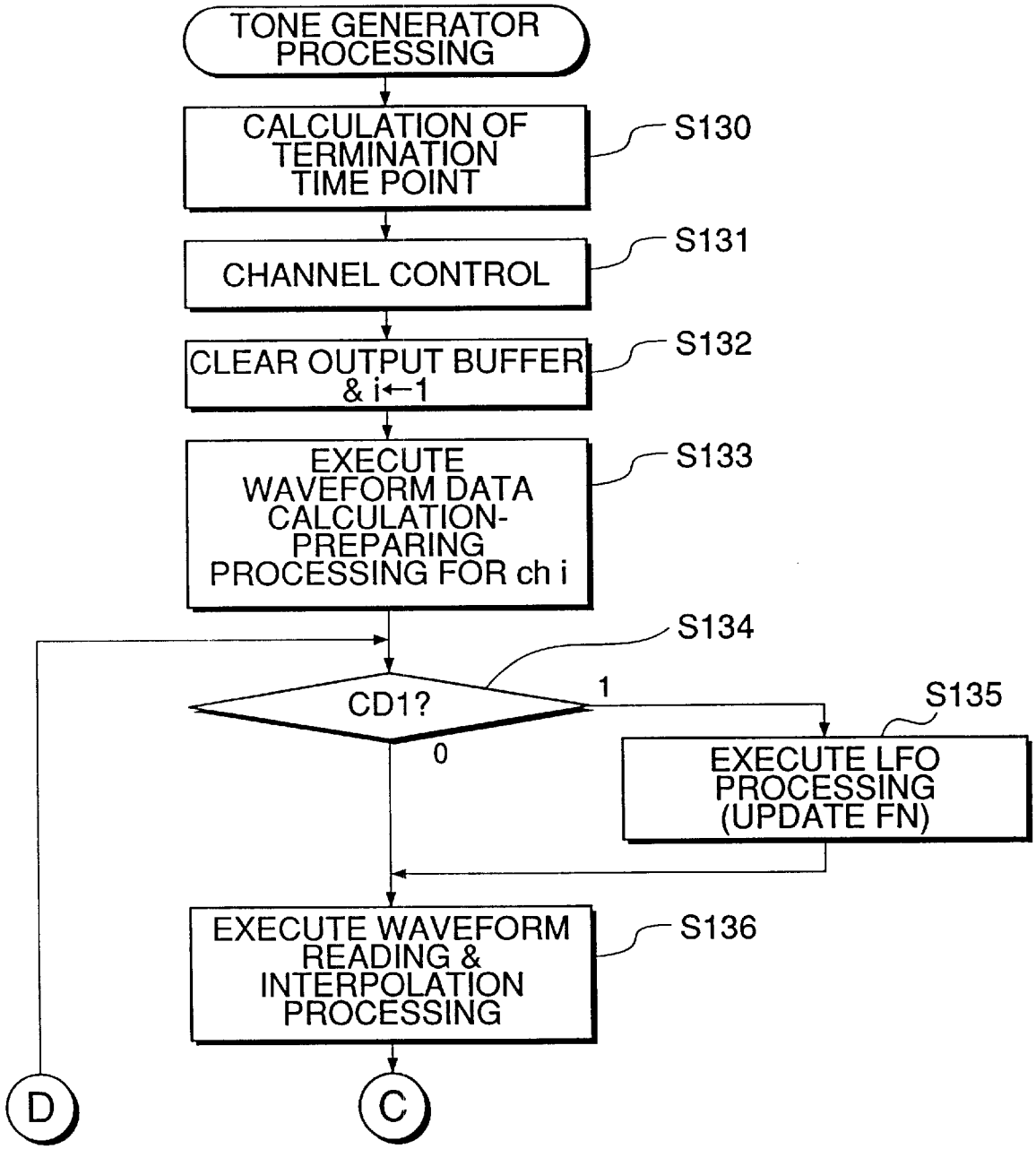
FIG. 18A is a flowchart showing tone generator processing, which is executed at a step S108 in FIG. 16.
Figure 18B:
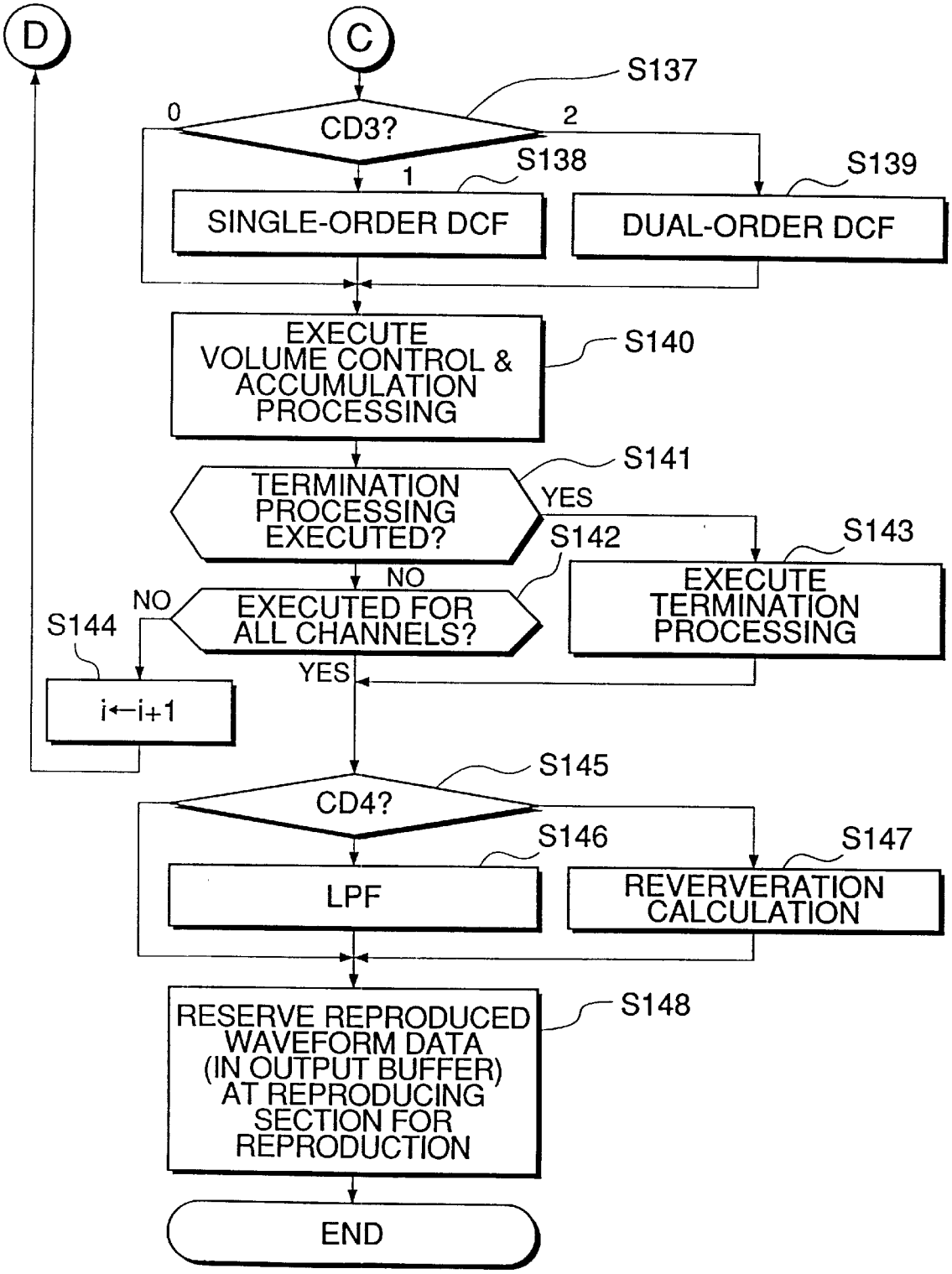
FIG. 18B is a continued part of the FIG. 18A flowchart.
Figure 19:
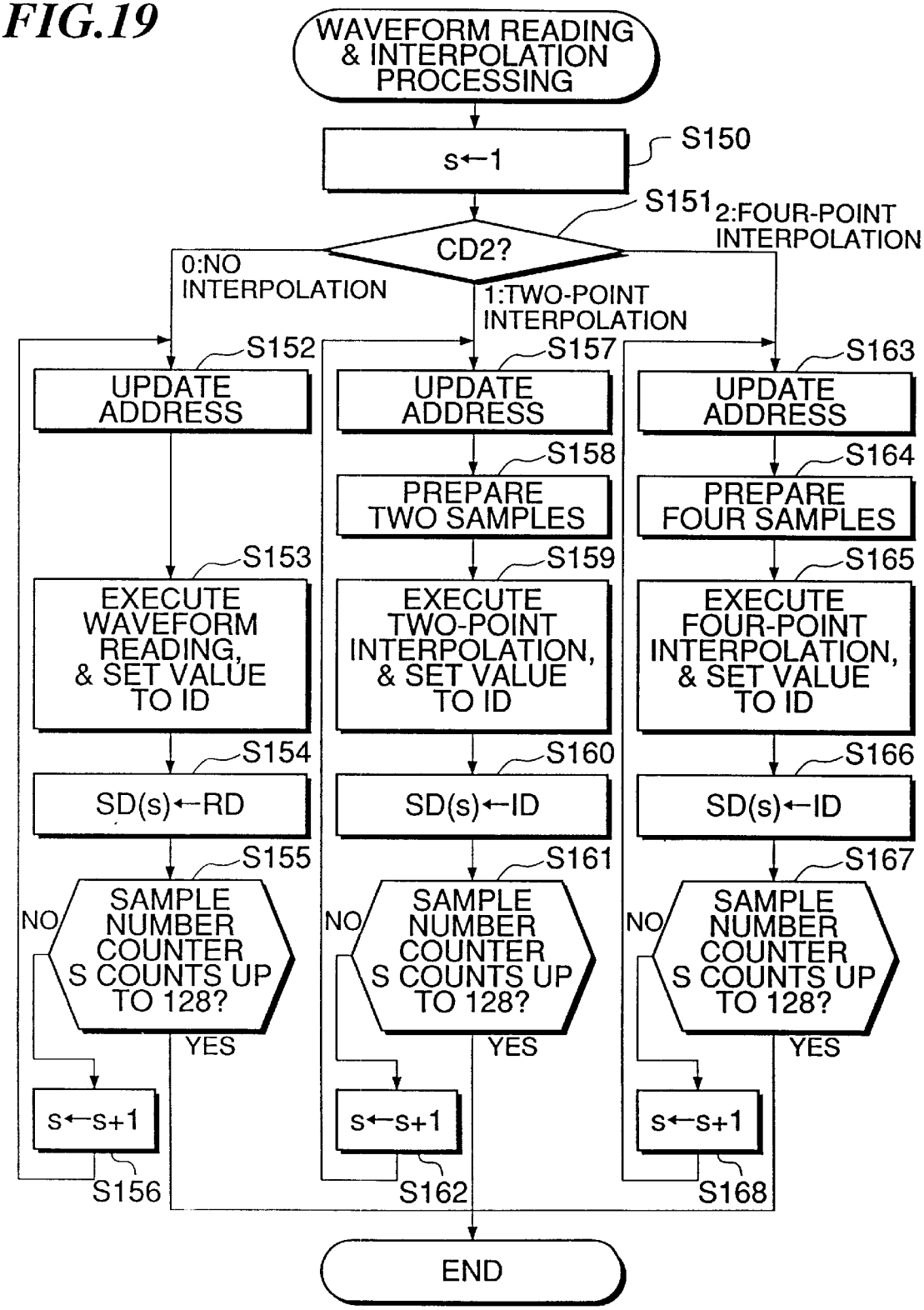
FIG. 19 is a flowchart showing waveform reading and interpolating processing, which is executed at a step S136 in FIG. 18.

FIG. 16 shows a main routine executed by the CPU 1. When the program is triggered, first, initializations such as presetting of register areas are executed at a step S101, and then a view to be displayed on the screen shown in FIG. 15 is prepared at a step S102. Further, occurrence of a triggering factor is waited at steps S103 and S104. If a triggering factor occurs, the contents of the triggering factor is determined at a step S105, followed by executing a corresponding processing. The triggering factor includes MIDI processing to be executed when MIDI data is written into the input buffer at a step S106, tone generator processing to be executed at predetermined time intervals corresponding to one frame at a step S108, other processings to be executed when other switch events occur at a step S110, and termination processing to be executed when a termination command is input at a step S112. The termination processing is for saving set data and for clearing registers. After execution of the termination processing, the view of FIG. 15 is closed, followed by terminating the program. When the MIDI processing has been executed at the step S106, a display of the MIDI monitor 31, corresponding to a channel which has received the MIDI data is lit up at a step S107. The other processings include processings corresponding to various panel inputtings and command inputtings, part of which will be described hereinafter with reference to FIG. 21. After execution of the other processings, display-changing processing corresponding to execution of the other processings is executed at a step S111. The tone generator processing at the step S108 is executed upon detection that reading-reproducing processing shown in FIG. 4C has advanced to the next frame, which is caused by interruption triggered by counting-up of 128 sample clocks by the timer 7 or caused by trigger by the DMA controller 9. The tone generator processing will be described in detail with reference to FIGS. 18A, 18B and 19. Duty ratio/generated musical tone number display processing (P display processing) at a step S109 will be described with reference to FIG. 19. In this connection, FIGS. 18A, 18B and 19 are concerned with the second embodiment in which on/off switching of the LFO, interpolation setting, digital filter setting, effect setting can be performed by operating the cursor in the control view on the display 3. On the other hand, FIGS. 22A and 22B are concerned with the third embodiment in which sampling frequency setting can be performed by operating the cursor in the control view on the display 3. In the present specification, the fourth embodiment will be also briefly described in which the maximum number of musical tones to be generated (maximum number of tone-generating channels used for tone generation) can be set by operating the cursor in the control view.

Figure 17:
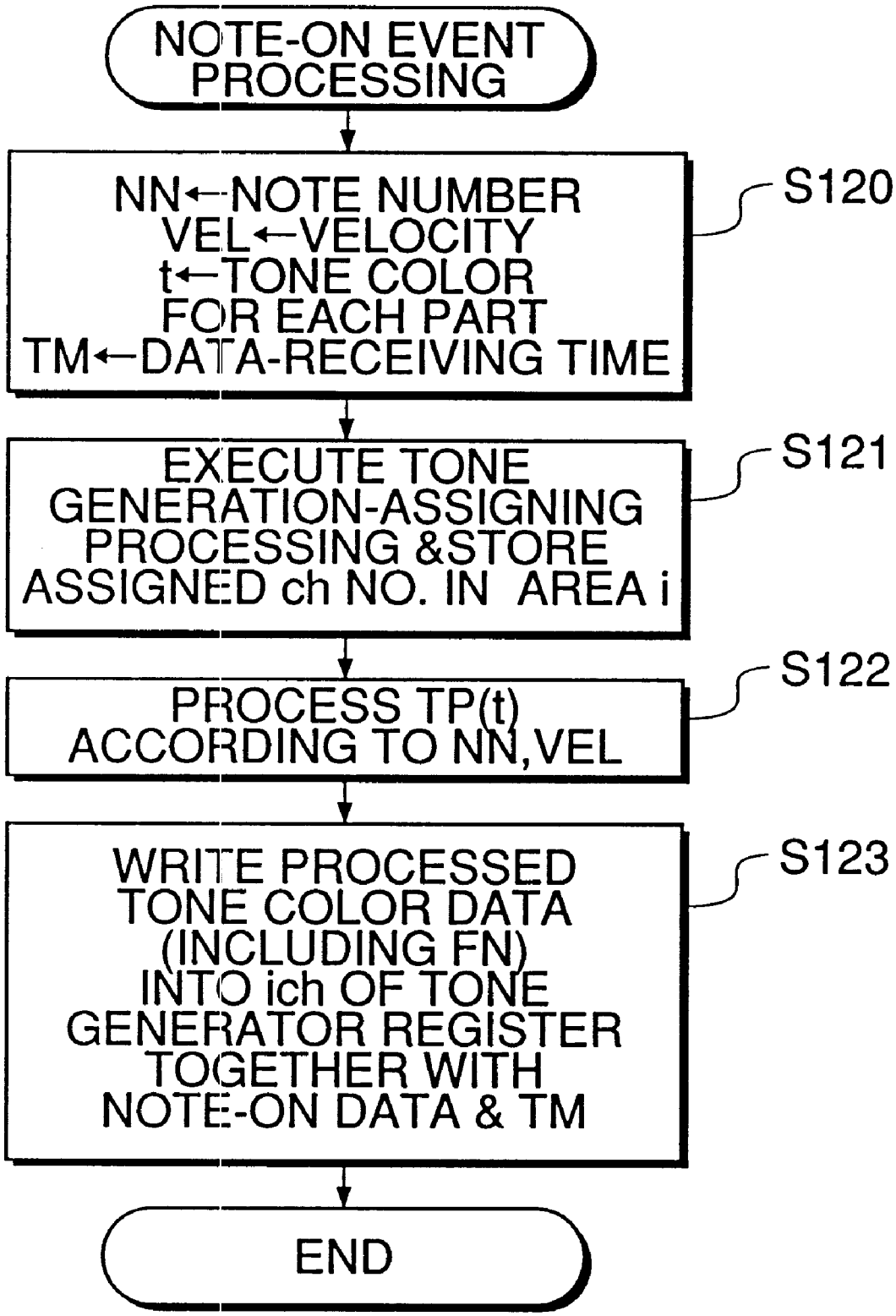
FIG. 17 is a flowchart showing note-on event processing, which is one of MIDI processings executed by the FIG. 16 main routine.

FIG. 17 shows details of a note-on event processing which is one of the MIDI processing and similarly to the MIDI-receiving interrupt processing of FIG. 6, executed when note-on event data has been written into the input buffer.

First, at a step S120, the note number, velocity and tone number for each part in the received data are set as parameters NN, VEL and t, respectively, and at the same time the event occurrence time point (data-receiving time) is set as a parameter TM. Then, at a step S121, tone generation-assigning processing is performed for determining a tone-generating channel of the tone generator register (FIG. 14D)

into which tone color data is to be written, and the assigned channel number is set as a parameter i. At the following step S122, tone color data TP(t) read from the RAM 6 according to the tone number t for each part is processed according to the note number NN and velocity VEL. Further, the tone color data (including tone-generating pitch FN) thus processed is written into the i-channel register of the tone generator register together with the note-on data and the event occurrence time point TM at a step S123, followed by terminating the program.

FIGS. 18A and 18B show a program for carrying out the tone generator processing triggered at the time intervals corresponding to one frame.

First, at a step S130 in FIG. 18A, a calculation is made of a time point at which the tone generator processing is to be terminated. The termination time point is calculated based on the duty ratio of capacity occupied by the software tone generator to the whole capacity of the CPU 1, and the processing at the step S130 is to calculate a time period over which musical tone waveform data can be generated (tone generator processing). More specifically, in the tone generator processing, waveform data for one frame (128 samples) is calculated for 32 channels, however, when a predetermined time period over which the CPU can be occupied has elapsed, the processing is forcedly terminated even before the calculation of the waveform data is completed. If the processing is interrupted, waveform data for some channels cannot be calculated. In such a case, musical tones from such channels are forcedly damped, i.e. the volume level of the musical tone signals is sharply lowered to stop generation of musical tones. The forced-damping time point TL (time limit) can be calculated by the following equation (2):

$$TL=ST+FL\times DR-US-AS \quad (2)$$

where ST represents a starting time point of the frame to be currently reproduced, FL one frame time length (length of one frame), DR the duty ratio, US a termination time period (a time period required for terminating the processing (forced damping), and AS a post-processing time period (a time period required for executing reverberation processing, LPF calculation, etc. on generated waveforms for a plurality of channels and then reserving the waveforms for reproduction by the DMA controller 9, to thereby complete the tone generator processing).

The time limit TL thus indicates how long the musical tone-generating processing for each channel executed during the tone generator processing for each frame should be continued. According to the equation (2), out of a time period from the current frame-starting time point (ST) to the current frame-completing time point (ST+FL), a first time period determined by the duty ratio is spared for the tone generator processing, and the rest time period for other processings by the software tone generator and other application processings. The duty ratio DR is set by the duty ratio switch 44. In the above equation (2), the time limit is precisely calculated by taking the termination time period US and the post-processing time period AS into consideration, however, these considerations may be omitted.

Next, channel control is executed at a step S131. The channel control is for setting the calculation sequence between the 32 channels such that a channel for generating a musical tone with higher priority (channel for generating a musical tone which cannot be dispensed with) is earlier subjected to waveform calculation, since as will be learned from the above description, waveform calculation for a channel given a lower order of calculation has a higher possibility of being terminated before it is completed. The channel for generating a musical tone with higher priority means a channel for generating a musical tone with a higher sound level or a channel for generating a musical tone sounded over a short time period. On the other hand, the channel for generating a musical tone with lower priority means not only a channel which is not currently used for sounding, but also a channel for generating a musical tone with a lower sound level. After execution of the channel control, the output buffer OB is cleared and a pointer i indicative of the calculation sequence is set to 1 at a step S132. Thereafter, waveform data calculation processing at steps S133 to S144 is executed for each tone-generating channel.

First, at the step S133, an address designated by an address pointer in the RAM 6 is set to an address corresponding to a channel of the tone generator register having the i-th order of calculation sequence to enable reading data for the channel i to thereby execute waveform data calculation-preparing processing. Then an LFO control flag CD1 is checked at the step S134. If CD1=1 holds, LFO processing is executed at the step S135. The LFO processing is for frequency-modulating an F number FN corresponding to the note number NN by an LFO waveform (i.e. vibrato processing). The frequency of the LFO is lower than the musical tone frequency and one frame has a short time period (128 samples), and therefore one value of LFO frequency is sufficient for one frame. If no vibrato processing is required, the program proceeds from the step S134 to the step S136. At the step S136, waveform reading from the designated waveform table and interpolation processing are executed.

The waveform-reading and interpolating processing at the step S136 will now be described in detail with reference to FIG. 19. In the processing, waveform data for the channel designated by the parameter i is calculated for one frame (128 samples). First, at a step S150, a sample number counter s is set to 1. Then, at a step S151, an interpolation method is selected by referring to an interpolation method register CD2. If CD2=0 holds, no interpolation is performed, such as a case where percussion instrument tones requiring no pitch conversion are to be generated. If CD2=1 holds, a two-point interpolation is performed, such as a case where a rough interpolation is sufficient. If CD3=2 holds, a four-point interpolation is performed, such as a case where delicate musical tones in which aliasing noise can be conspicuous are to be generated.

If no interpolation is performed, the F number FN is added to an address applied by the immediately preceding calculation (in the present embodiment, an address generated at the end of the waveform reading in the immediately preceding frame for the tone-generating channel for which the current calculation is being performed), to thereby update the address, at a step S152. A waveform sample is read from the designated waveform table according to the updated address and set to an RD register preset at a predetermined area of the RAM 6, at a step S153. Then, the contents of the RD register are set into a sample buffer WSD(s) at a step S154. The above processing is repeatedly executed until the sample number counter s counts up to 128 at steps S155 and S156. After the above processing has been executed 128 times, the program returns to the tone generator processing of FIGS. 18A and 18B.

In the above processing, the fraction part of the address caused by the fraction part of the F number FN is neglected, and therefore aliasing noise will be generated. However, if the F number FN does not contain a fraction part, this inconvenience will not occur.

If CD2=1 holds, i.e. if the two-point interpolation is performed, the address is updated by adding the F number FN to an address applied by the immediately preceding calculation at a step S157. In this case, the updated address contains an integer part and a fraction part, and therefore waveform data of two samples sandwiching the address (samples designated by an address of the integer part and an address of the integer part plus 1)) are read out from the designated waveform table at a step S158. The data of the two samples are linearly interpolated based on a value of the fraction part, and the resulting value is set into an ID register preset in the RAM 6, at a step S159. Then, the contents of the ID register are set into the sample buffer WSD(s) at a step S160. The above processing is repeatedly executed until the sample number counter s counts up to 128 at steps S161 and S162. After the above processing has been executed 128 times, the program returns to the tone generator processing of FIGS. 18A and 18B.

If CD2=2 holds, i.e. if the four-point interpolation is performed, the address is updated by adding the F number FN to an address applied by the immediately preceding calculation at a step S163. In this case, the updated address contains an integer part and a fraction part, and therefore waveform data of four samples sandwiching the address (samples designated by addresses of the integer part minus 1, the integer part, the integer part plus 1, and the integer part plus 2) are read out from the designated waveform table at a step S164. A value of a point corresponding to the fraction part on a cubic curve connecting the four samples is determined, and the determined value is set into the ID register at a step S166. Then, the contents of the ID register are set into the sample buffer WSD(s) at a step S166. The above processing is repeatedly executed until the sample number counter s counts up to 128 at steps S167 and S168. After the above processing has been executed 128 times, the program returns to the tone generator processing of FIGS. 18A and 18B.

Referring again to FIG. 18A, after execution of the waveform reading and interpolating processing, a filter control register CD3 is checked at a step S137 in FIG. 18B. If CD3=0 holds, digital filter processing is not executed, followed by the program proceeding to a step S140 to execute volume control and accumulation processing. If CD3=1 holds, single-order filter processing having a frequency characteristic corresponding to the filter control data is executed on the values of the sample buffers WB (WSD(l) to WSD(128)) at a step S138. On the other hand, if CD3=2 holds, dual-order filter processing having a frequency characteristic corresponding to the filter control data is executed on the values of the sample buffers WB at a step S139. Then, the volume control and accumulation processing is executed at the step S140.

At the step S140, volume control is effected, which applies a volume time variation from a leading edge of a musical tone waveform to a trailing edge of the same on the values of the sample buffers WB (WSD (1) to WSD (128)), based on amplitude envelope generator (EG) and channel volume parameters. The amplitude EG generally generates a moderate curve, and therefore a single EG value suffices for 128 samples. The thus level-controlled values of the sample buffers WB are added to respective samples in output buffers OB (OD(l) to OD(128)). The addition is, repeatedly executed for each channel having the i-th calculation order, whereby an accumulated value of the musical tone waveform data so far generated for all the channels is stored in the output buffer OB.

Thereafter, it is determined at a step S141 whether or not the termination time point TL has been reached. If the termination time point TL has been reached, termination processing is executed at a step S143, that is, damped waveforms are generated for forcedly damping musical tone waveforms for channels for which waveform data have not yet been calculated up to the termination time point, and the thus generated waveforms are added to data in the output buffer OB.

If the termination time point has not been reached, it is determined at a step S142 whether or not the processing has been executed for all the channels currently used for tone generation. Although 32 channels are provided in the tone generator register, if the number of channels currently used for tone generation is less than 32 and the answer to the question at the step S142 is affirmative (YES), when the musical tone generation processing has been completed for these channels, then the program proceeds to step S145 et seq. On the other hand, if the musical tone generation processing has not been completed for all the channels currently used for tone generation, 1 is added to the i value indicative of the calculation sequence at a step S144, followed by the program returning to the step S133.

If the musical tone generation processing has been completed for all the channels, or if the termination processing has been effected, the program proceeds to the step S145, wherein an effect control register CD4 is checked. If CD4=0 holds, effect imparting is not performed, followed by the program skipping to a step S148. If CD4=1 holds, low pass filter calculation is performed to cut off high frequency components of the 128 samples in the output buffer OB by a low pass filter LPF at a step S146, followed by the program proceeding to the step S148.

If CD4=2 holds, a reverberation calculation is executed to impart reverberation to the 128 samples in the output buffer OB, at a step S147, followed by the program proceeding to the step S148.

At the step S148, reproduction of the waveform data thus prepared and stored in the output buffer OB is reserved by notifying the DMA controller 9 of the addresses stored in the RAM 6.

Figure 20:
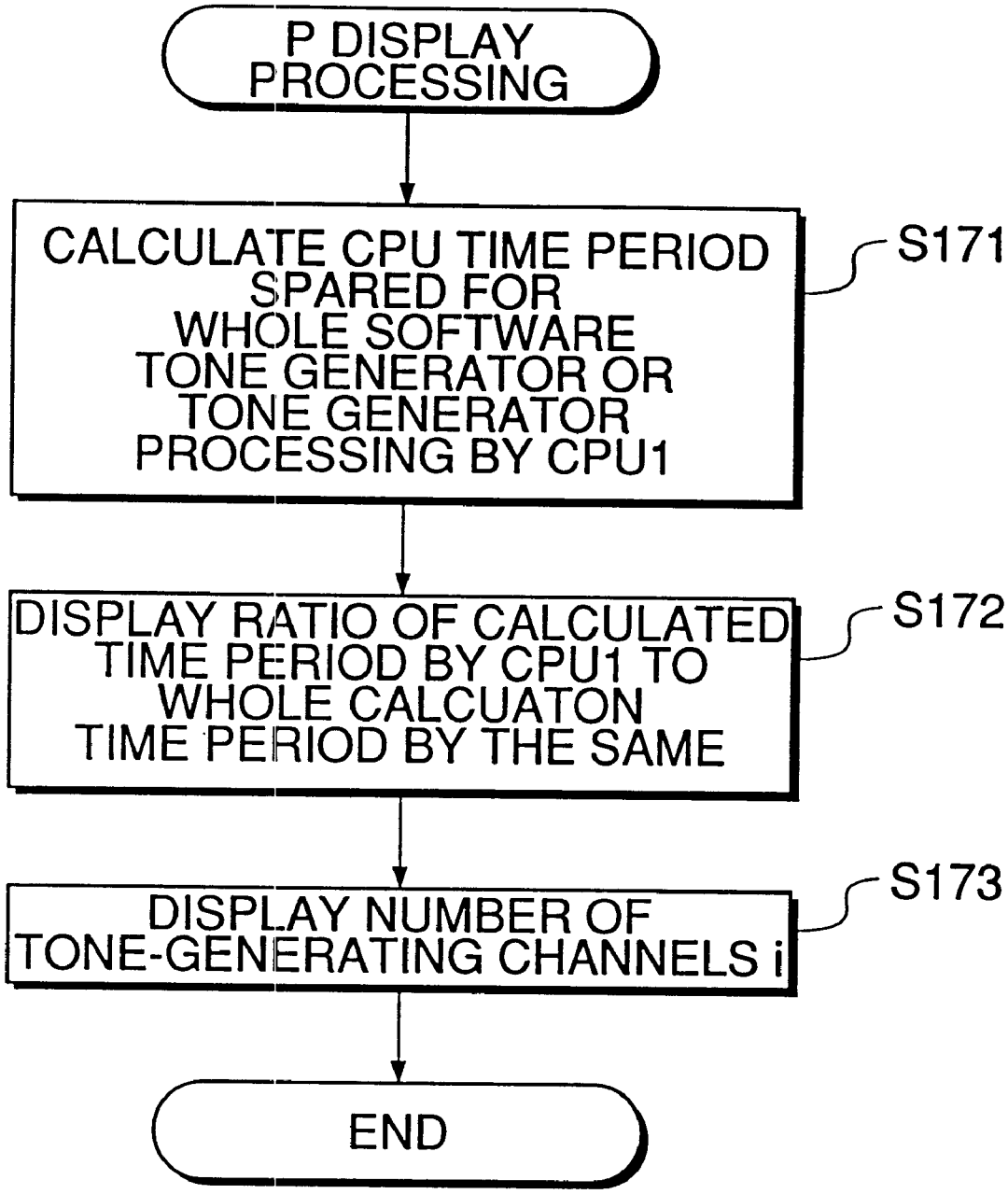
FIG. 20 is a flowchart showing P-display processing, which is executed at a step S109 in FIG. 16.

FIG. 20 shows a program for executing the duty ratio and generated musical tone number display processing (P display processing). First, at a step S171, a CPU time period spared for the whole software tone generator or the tone generator processing by the CPU 1 is calculated. A ratio of the thus calculated time period spared by the CPU 1 to the whole calculation time period by the same is calculated, and the calculated ratio is displayed on the CPU occupation ratio display section 40 in bar chart at a step S172. Then, the number of tone-generating channels currently used for tone generation is displayed on the currently sounded channel number display section 39 at a step S173.

Figure 21A:
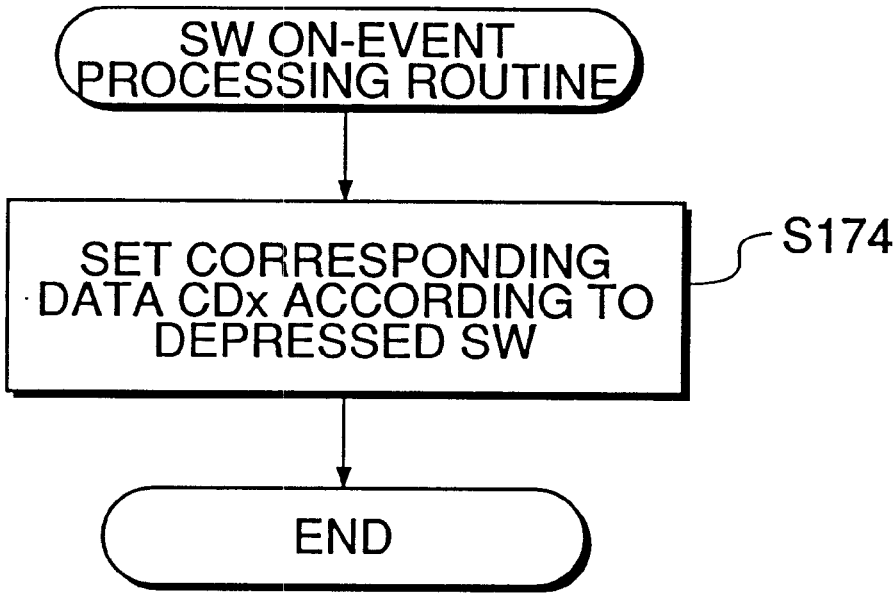
FIG. 21A is a flowchart showing switch-on even processing, which is one of other processings executed at a step S109 in FIG. 16.

FIG. 21A shows a program for carrying out switch-on event processing which is one of the other processings. If the switch 43 displayed on the display window 30 is depressed, a value of data CDx corresponding to the current location of the cursor 32 is set according to an operating amount and direction of the depressed switch. The data CDx is used in the above described tone generator processing.

According to the present embodiment, the cursor 32 can be moved by means of the cursor key 42 to any location of the LFO on/off display section 33, the interpolation-setting display section 34, the digital filter-setting display section 35, and the effect-setting display section 36 in the control view of the display shown in FIG. 15. According to the operation of the value switch 43, data corresponding to the location of the cursor 32, i.e. the data CD1 is set and changed at the LFO on/off display section 33, the data CD2 at the interpolation-setting display section 34, the data CD3 at the digital filter-setting display section 35, and the data CD4 at the effect-setting display section 36, respectively.

Figure 21B:
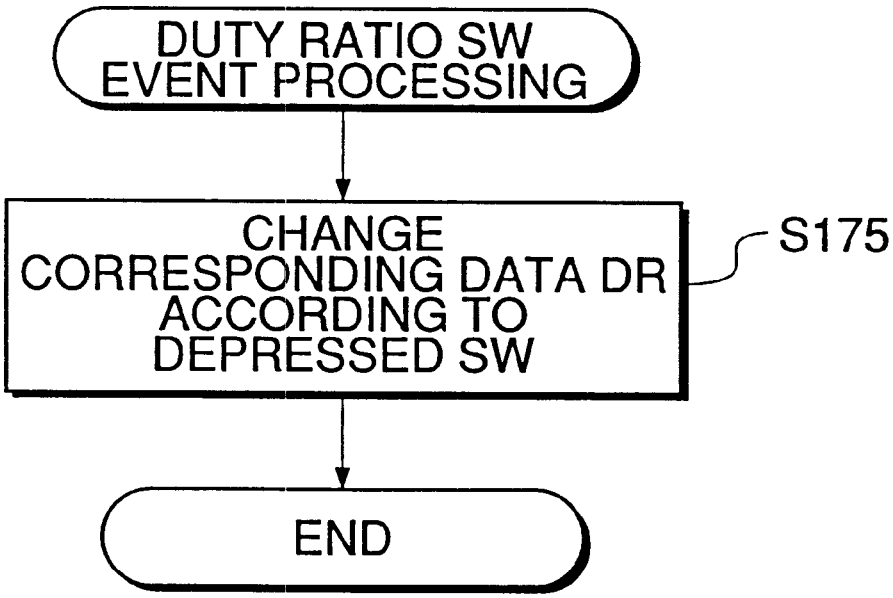
FIG. 21B is a flowchart showing duty ratio switch-on event processing, which is also one of other processings executed at the step S109.

FIG. 21B shows a program for carrying out duty ratio switch-on event processing. When the duty ratio switch 44 is depressed, the data duty ratio DR is changed according to an operating amount and direction of the depressed switch, and the dotted line 40*b* of the CPU occupation ratio display section 40 is changed according to the changed data duty ratio DR at a step S175.

Figure 22A:
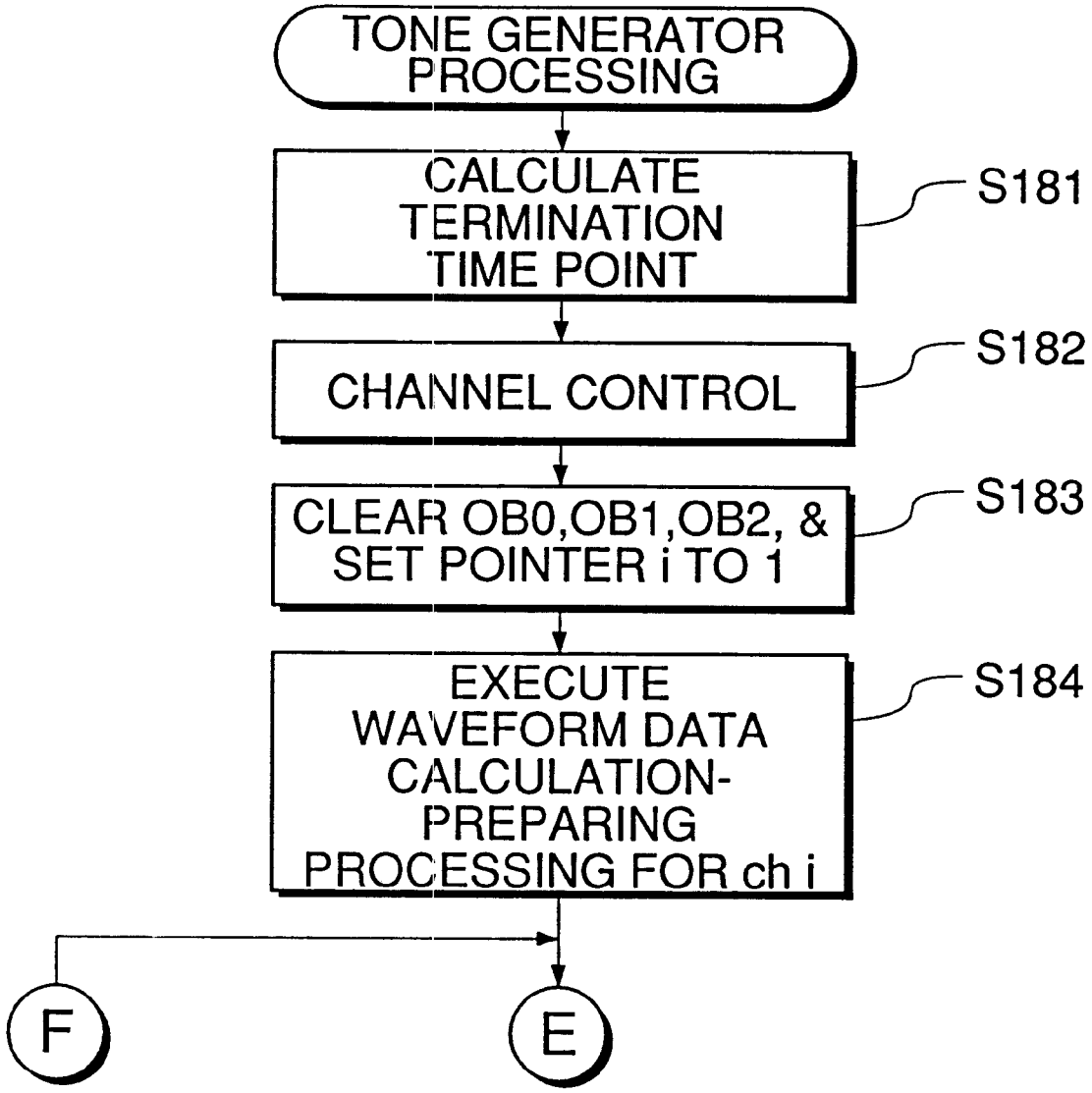
FIG. 22A is a flowchart showing tone generator processing executed by a CPU, according to a third embodiment of the invention.
Figure 22B:
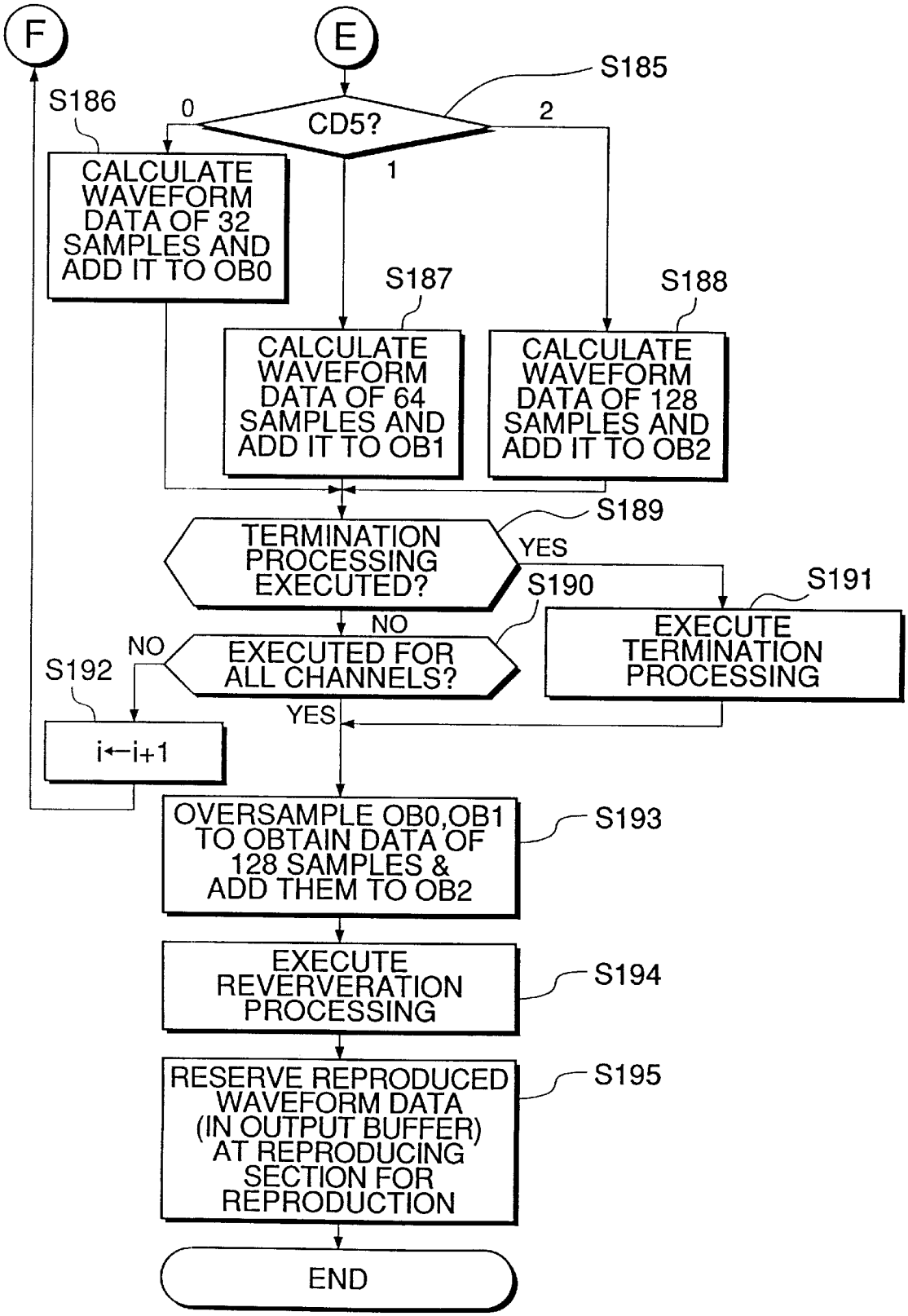
FIG. 22B is a continued part of the FIG. 22A flowchart.

FIGS. 22A and 22B show a program for carrying out tone generator processing executed by a musical tone-generating apparatus according to a third embodiment of the invention. First, at a step S181 in FIG. 22A, a calculation is made of a time point at which the tone generator processing is to be terminated. The termination time point TL is determined by the use of the above-mentioned equation (2):

$$TL=ST+FL\times DR-US-AS \quad (2)$$

where ST represents a starting time point of the frame to be currently reproduced, FL one frame time length (length of one frame), DR the duty ratio, US a termination time period (a time period required for termination the processing, and AS a post-processing time period (a time period required to shift to other processing).

Next, channel control is executed at a step S182, for setting the calculation order between 32 channels such that a channel for generating a musical tone with higher priority is earlier subjected to waveform calculation. Thereafter, three independent output buffers OB0, OB1 and OB2 are cleared and a pointer i indicative of the calculation order is set to 1 at a step S183, followed by execution of steps S184 to S192. The output buffers OB0, OB1 and OB2 correspond to the buffers 2, 1 and 0 in FIG. 3, respectively.

First, at the step S184, waveform data calculation-preparing processing including setting an address corresponding to the channel i of the tone generator register (channel i register) is executed. Then, a sampling frequency control register CD5 is checked at a step S185 in FIG. 22B. If CD5=2 holds, which means that waveform data for one frame (128 samples) is to be formed with the original degree of accuracy (i.e. at the original equivalent sampling frequency), waveform data of 128 samples is calculated and added to data in the output buffer OB2 at a step S188. If CD5=1 holds, which means that waveform data for one frame is to be formed with half of the original degree of accuracy (at half of the equivalent sampling frequency: 64 samples), waveform data of 64 samples is calculated and added to data in the output buffer OB1 at a step S187. If CD5=0 holds, which means that waveform data for one frame is to be formed with a quarter of the original degree of accuracy (at a quarter of the equivalent sampling frequency: 32 samples), waveform data of 32 samples is calculated and added to data in the output buffer OB0 at a step S186.

The value of the register CD5 (hereinafter referred to as "the data CD5") may be set for each channel i separately as data CD5(i) depending on a musical part of musical tones allotted to the channel when the channel is sounded, or alternatively it may be set as a single value CD5 for the whole software generator.

In the latter case, i.e. to set the data CD5 as a single value, the cursor is placed at the sampling frequency-setting display section 37 in the control view of FIG. 15 and the value switch 43 is operated. Then, according to the answer to the question of the step S185 which depends upon the single data CD5 value, the program proceeds to one of the steps S186 to S188 to carry out the corresponding processing described above.

On the other hand, if the data CD5 is set for each channel depending on a musical part of musical tones to be generated, the data CD5 is set for each of 1 to 16 MIDI channels. More specifically, the user sets the data CD5 to 16 values CD5(1) to CD(16) for the respective 16 MIDI channels, before performance. Further, when a note-on event is input to execute the note-on event processing of FIG. 17, during writing processing into the channel i tone generator register executed at the step S123, the data CD5(i) for the MIDI channel corresponding to the part t for which the event is input is set to the tone generator register. That is, the data CD5(i) set for the part t is set as the data CD5(i) for the assigned tone-generating channel i of the tone generator register. Thus, the data CD5(i) is set for each tone-generating channel i, and the steps S186 to S188 following the step S185 are executed depending on the data CD5(i) for each tone-generating channel i.

Next, musical tone characteristics controlled by the data CD5 will be described hereinbelow. In the tone generator processing of FIGS. 22A and 22B, by selectively executing the steps S186 to S188 depending on the determination of the step S185, the number of waveform samples to be generated as waveform data for one frame is changed. The larger the number of waveform samples for each channel to be generated for one frame, the longer a time period required for processing data for the channel. That is, there is a correlation between the number of waveform samples to be generated and the processing time period. In the present embodiment, the number of frames to be generated per second is fixed (48(kHz)/128=378 frames), and accordingly a change in the number of samples to be generated per frame corresponds to a change in the equivalent sampling frequency. The equivalent sampling frequency is set according to the data CD5 to 48 kHz (CD5=2), 24 kHz (CD5=1), and 12 kHz (CD5=0).

Referring again to FIG. 22B, it is determined at a step S189 whether or not the termination time point TL has been reached. If the answer is affirmative (YES), termination processing is executed at a step S191 in a manner similar to the second embodiment described before.

On the other hand, if the termination time point TL has not been reached, it is determined at a step S190 whether or not the processing for all the channels has been completed. If the answer is negative (NO), 1 is added to i at a step S192, followed by the program returning to the step S184 in FIG. 22A.

If the processing has been executed for all the channels, or the termination processing has been executed, the program proceeds to a step S193, wherein the contents of the output buffer OB0 are oversampled at a frequency four times of the equivalent sampling frequency (4-multiple over sampling) to obtain data of 128 samples which is added to data in the output buffer OB2. Further, the contents of the output buffer OB1 are oversampled at a frequency two times of the equivalent sampling frequency (2-multiple over sampling) to obtain data of 128 samples which is added to the data in the output buffer OB2. Then, the waveform data stored in the output buffer OB2 is subjected to reverberation processing at a step S194, and the reverberated waveform data in the output buffer OB2 is reserved at the DMA controller 9 for reproduction at a step S194.

By virtue of the above setting of the data CD5, the sampling frequency is changed to generate musical tone waveforms, which makes it possible to generate musical tone waveforms depending on the capacity of the CPU 1.

In the fourth embodiment, the maximum number of tone-generating channels to be sounded simultaneously by the software tone generator is limited to 32 or less as data CD6 beforehand, and the termination processing at the step S141 in FIG. 18B is executed based on results of a determination as to whether or not the number of currently sounded tone-generating channels has reached the limited maximum number. That is, according to the fourth embodiment, the data (1) indicative of the maximum number of tone-generating channels to be sounded simultaneously is set by the user at the maximum tone-generating channel number-setting display section 38 in FIG. 15, and then the software tone generator generates musical tones based on the data CD6 value as the maximum number of tone-generating channels to be sounded simultaneously, i.e. using the limited maximum number or less of channels. In this case, the occupation ratio (duty ratio) of the CPU 1 can be limited by thus controlling the number of tone-generating channels to be sounded simultaneously.

Next, description will made of a fifth embodiment of the invention. In the second and third embodiments described before, the upper limit of the capacity of the CPU 1 to be used for the software tone generator processing out of the whole capacity of the CPU 1 is controlled based on the duty ratio DR set by the user. On the other hand, according to the fourth embodiment described above, the maximum number of tone-generating channels to be sounded by the software tone generator is limited to the value CD6 set by the user. In each of the embodiments, the number of tone-generating channels sounded by the software tone generator is changed. However, the change is effective only inside the tone generator processing for generating waveforms at the step S108, but not effectively applied to processings other than the tone generator processing, e.g. to the tone generation-assigning processing (tone-generating channel assignment processing).

According to the present embodiment, when note-on event processing is executed in a tone generator which can change the number of tone-generating channels to be sounded simultaneously, the tone-generating channel assignment at the step S121 is changed according to the number of tone-generating channels to be currently sounded simultaneously. That is, in the note-on event processing at the step S121, the number of channels to be sounded simultaneously corresponding to the capacity (calculation capacity) of the CPU 1 according to the data duty ratio DR, or the data CD6 is received, and the musical tone assignment is executed with the maximum number of tone-generating channels MP set by the value of the received data. If the number PN of channels currently generating musical tones in the tone generator register is smaller than a value (MP−1), an empty channel or empty channels MP are assigned to tone generation, i.e. set to generate musical tones. On the other hand, if the channel number PN is larger than the value (MP−1), a channel or channels corresponding in number to a number (PN−MP+1) which exceeds the value (MP−1) are set as a channel or channels to be subjected to tone generation-decaying, and a command to stop tone generation is issued to the channel or channels, and at the same time a single empty channel is preserved as a channel assigned to tone generation. According to the processing, the musical tone assignment is carried out based on the number of channels currently sounded, which can prevent assignment of tone generation to too many channels which causes noises or assignment of tone generation to too few channels which causes unsatisfactory use of the tone-generating capacity of the tone generator. The number of channels to be sounded simultaneously quickly or incessantly changes with the lapse of time when the amount of processing per channel is changed due to change of the tone color or when the data DR or the value CD6 is changed during performance of music. However, according to the present embodiment, the number of channels to be sounded simultaneously by the tone generator is obtained when the musical tone assignment is executed upon inputting of a note-on event, etc., to enable coping with such a quick or incessant change in the number of channels sounded simultaneously. This method is not limitative to the software tone generator but also applicable to all types of tone generators which are capable of changing the maximum number of channels to be sounded simultaneously according to conditions.

Although in the above described embodiments, the on/off setting of the digital filter DCF is carried out on the whole software tone generator, the on/off-setting may be carried out on each tone color part and/or each tone-generating channel. That is, a digital filter-setting register CD3(i) may be preset for each of tone color parts and/or tone-generating channels, and the on/off-setting of the digital filter DCF may be effected in each setting mode of the tone color part and/or the tone-generating channel. In the aforedescribed tone generator processing of FIGS. 18A and 18B, the determination at the step S137 is carried out for each tone-generating channel, to thereby easily cope with the on/off-setting of the digital filter for each of tone color parts and/or tone-generating channels. Further, the other data CD1, CD2, etc. may be preset for each tone color part and/or each tone-generating channel, similarly.

To generate rhythmic tones, pitch conversion is generally unnecessary, and therefore the data CD2 is set to 0 (no interpolation). To tune musical tones for other musical instruments, however, the data CD2 may be set to 1 to control the pitch.

In the above described embodiments, the MIDI event processing is not considered in carrying out the duty ratio control calculation. The duty ratio control calculation may, however, take the MIDI even processing into consideration as one of operations carried out by the software tone generator.

Display of the CPU power and the number of generated musical tones (tone-generating channels) can change at a high speed, and therefore, for easy watching by the user, smoothing processing of the display may be carried out.

It may be so arranged that the software tone generator receives, as input performance data, not only MIDI data from an external device but also MIDI events reproduced through an automatic performance program executed by the computer per se as well as tone-generating instructions generated through game software, etc.

The software tone generator according to the invention may be implemented, as described before, by a general purpose computer in which an operating system (OS) such as Windows (Registered Trademark) is installed. But, this is not limitative. The software tone generator may be implemented by a control CPU provided in an electronic musical instrument with performance operating elements such as a keyboard or a tone generator module with no performance operating element. In the latter case, a tone generator section conventionally formed by an electronic circuit may be reduced or omitted. Alternatively, a hardware tone generator section and the software tone generator may be both employed.

In the effect control according to the above described embodiments, one of no-effect-executing processing, low pass filter processing and the reverberation processing is selected based on the value of the data CD4. In other words, two different types of effects, i.e. the low pass filter processing and reverberation processing can be selectively imparted to waveform data. Selection of the two types of effects can be regarded as selection of different calculation amounts required for the processing. Other embodiments of effect selection are possible. For example, the user may select one of a plurality of effect programs which are the same in effect type but different in the grade of effect processing and the calculation amount required for processing. That is, if the grade of effect processing is increased, the calculation amount required for other processings is decreased, resulting in a decreased number of tone-generating channels to be sounded simultaneously. Therefore, the user may control the balance between the number of channels to be sounded simultaneously and the effect grade by setting the CD4 value.

Figure 4:
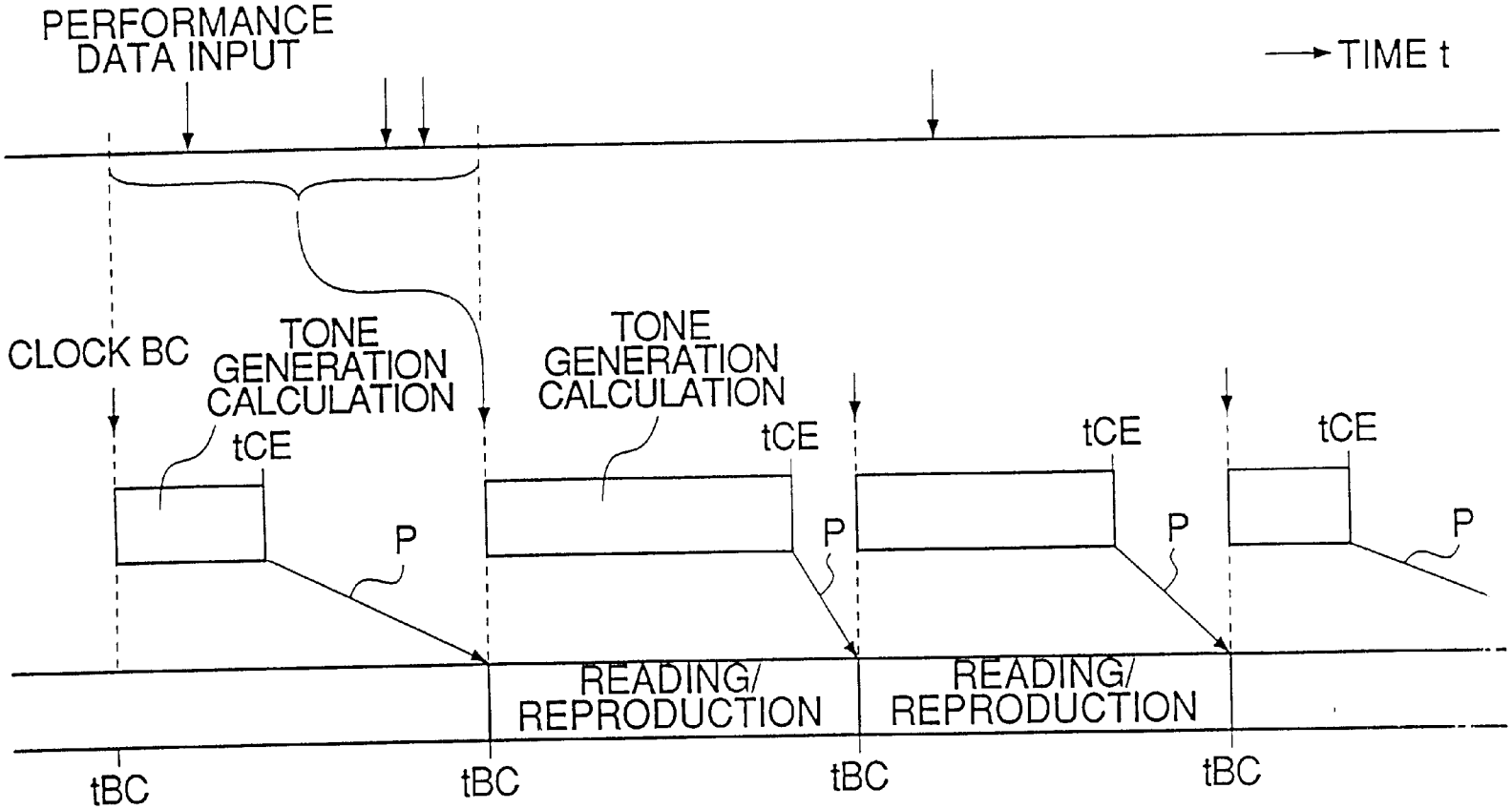
FIG. 4 is a timing chart useful in explaining an outline of processing for generating musical tones, which is performed by the apparatus of FIG. 1.

Further, the time flow of processing executed by the software tone generator, shown in FIG. 4, shows only an example. The time correlations between frame size, inputting of performance data, waveform calculation, and reading and reproducing of waveform data are not limited by the figure. For example, the timing of the performance data inputting, waveform calculation, and reading and reproducing of waveform data with respect to the frame may be differently set. Besides, although the time length of one frame is fixed in the above described embodiments, it may be variable for every frame. However, the present invention is characterized in that a plurality of waveform samples can be generated in the time direction by one tone-generator processing.

What is claimed is:

1. A method of generating musical tones which is executed on a computer, comprising:

a performance information receiving step of receiving performance information which designates a pitch of each of the musical tones to be generated;

a control information receiving step of receiving control information;

a generating step of carrying out, at predetermined time intervals, a musical tone waveform calculation in response to the received performance information, for generating a plurality of musical tone waveform samples for each of a plurality of channels, wherein the predetermined time intervals are longer than a sampling cycle of the musical tone waveform samples, each of the musical tone waveform samples generated has the pitch designated by said performance information, and the number of said waveform sample generated is controlled by said control information; and a reproducing step of playing back said musical tone waveform samples generated by said generating step.

2. A method as claimed in claim 1, wherein the received control information is input based on an input operation by a user.

3. A method of generating musical tones which is executed on a computer, comprising:

a receiving step of receiving a plurality of pieces of performance information corresponding respectively to a plurality of performance parts, wherein the received performance information designates a pitch of each of the musical tones to be generated;

a generating step of carrying out, at predetermined time intervals, a musical tone waveform calculation in response to the received performance information, for generating a plurality of musical tone waveform samples corresponding to said plurality of performance parts, wherein the predetermined time intervals are longer than a sampling cycle of the musical tone waveform samples, each of the musical tone waveform samples generated has the pitch designated by said performance information, and a sampling frequency of the musical tone waveform samples generated corresponding to at least one of said plurality of performance parts is different from the sampling frequency of the musical tone waveform samples generated corresponding to the other performance parts; and a reproducing step of playing back said musical tone waveform samples generated by said generating step.

4. A method of generating musical tones which is executed on a computer, comprising:

a first receiving step of receiving a plurality of pieces of performance information for commanding to generate musical tones;

a second receiving step of receiving limitation information defining a maximum number of channels for generating tones;

a generating step of carrying out, at predetermined time intervals longer than a sampling cycle, a musical tone waveform calculation of a plurality of sounding channels which said performance information has commanded to generate tones, for generating a plurality of musical tone waveform samples in said plurality of sounding channels, wherein when said performance information commands to start generation of a new tone, one new sounding channel is added to said plurality of sounding channels, and when the tone generation in one of said plurality of sounding channels is finished, said one of said plurality of sounding channels is removed from said plurality of sounding channels; and a reproduction step of outputting said plurality of musical tone waveform samples, sample by sample, every sampling cycle;

wherein said generating step generates said musical tone waveform samples by said musical tone waveform calculation in a manner such that a maximum number of said plurality of sounding channels is limited in accordance with said limitation information by inhibiting said musical tone waveform calculation for some of said plurality of sounding channels when a total number of said sounding channels exceeds the maximum number defined by said limitation information.

5. A method as claimed in claim 4, wherein the received limitation information is input based on a setting operation by a user.

6. A method of generating musical tones which is executed on a computer, comprising:

a first receiving step of receiving a plurality of pieces of performance information for commanding to generate musical tones;

a second receiving step of receiving limitation information defining a maximum amount of processing capacity of a processor of the computer which can be employed for tone generation;

a generating step of carrying out, at predetermined time intervals longer than a sampling cycle, a musical tone waveform calculation of a plurality of sounding channels which said performance information has commanded to generate tones, for generating a plurality of musical tone waveform samples in said plurality of sounding channels, wherein when said performance information commands to start generation of a new tone, one new sounding channel is added to said plurality of sounding channels, and when the tone generation in one of said plurality of sounding channels is finished, said one of said plurality of sounding channels is removed from said plurality of sounding channels; and a reproduction step of outputting said plurality of musical tone waveform samples, sample by sample, every sampling cycle;

wherein said generating step generates said musical tone waveform samples by said musical tone waveform calculation in a manner such that a total number of said plurality of sounding channels is limited in accordance with said limitation information by inhibiting said musical tone waveform calculation for some of said plurality of sounding channels when a total amount of processing capacity of the processor which is used by the musical tone waveform calculation in the generating step exceeds the maximum amount of processing capacity of the processor defined by said limitation information.

7. A method as claimed in claim 6, wherein the received limitation information is input based on a setting operation by a user.

8. A method of generating musical tones which is executed on a computer, comprising:

a performance information receiving step of receiving performance information which designates a pitch of each of the musical tones to be generated;

a control information receiving step of receiving control information;

a waveform sample generating step of carrying out, at predetermined time intervals longer than a sampling cycle, a musical tone waveform calculation of a plurality of sounding channels which said performance information has commanded to generate tones, for reading musical tone waveform samples from a memory, interpolating the read musical tone waveform samples in a manner selected by the control information, at a rate corresponding to a pitch designated for each of said sounding channels by said performance information, and generating a plurality of musical tone waveform samples for each of said sounding channels based on the musical tone waveform samples interpolated, wherein said musical tone waveform samples generated has the pitch designated by said performance information; and a reproducing step of outputting said musical tone waveform samples generated by said waveform sample generating step, sample by sample, every sampling cycle.

9. A method as claimed in claim 8, wherein the received control information is input based on a setting operation by a user.

10. A method of of generating musical tones which is executed on a computer, comprising:

a first receiving step of receiving performance information;

a second receiving step of receiving instruction information for instructing a digital filter to switch on or off;

a generating step of carrying out, at predetermined time intervals longer than a sampling cycle, a musical tone waveform calculation in response to the received performance information, for generating a plurality of musical tone waveform samples, and storing the generated plurality of musical tone waveform samples in a memory, wherein said musical tone waveform calculation includes a digital filtering step of filtering said generated plurality of musical tone waveform samples to control a tone color of said musical tone waveform samples, only when said instruction information for instructing the digital filter to switch on is received by said second receiving step; and a reproducing step of outputting said plurality of musical tone waveform samples, sample by sample, every sampling cycle.

11. A method as claimed in claim 10, wherein the received instruction information is input based on a setting operation by a user.

12. A method of generating musical tones which is executed on a computer, comprising:

a first receiving step of receiving performance information;

a second receiving step of receiving instruction information for instructing a low frequency oscillator to switch on or off;

a generating step of carrying out, at predetermined time intervals longer than a sampling cycle, a musical tone waveform calculation in response to the received performance information, for generating a plurality of musical tone waveform samples, and storing the generated plurality of musical tone waveform samples in a memory, wherein said musical tone waveform calculation includes a low frequency oscillator step of imparting vibrato to said generated plurality of musical tone waveform samples, only when said instruction information for instructing the low frequency oscillator to switch on is received by said second receiving step; and a reproducing step of outputting said plurality of musical tone waveform samples, sample by sample, every sampling cycle.

13. A method as claimed in claim 12, wherein the received instruction information is input based on a setting operation by a user.

14. A method of generating musical tones which is executed on a computer, comprising:

a first receiving step of receiving performance information;

a second receiving step of receiving selection information;

a generating step of carrying out, at predetermined time intervals longer than a sampling cycle, a musical tone waveform calculation in response to the received performance information, for generating a plurality of musical tone waveform samples for each of a plurality of channels, mixing the generated plurality of musical tone waveform samples for each of the plurality of channels, and storing the mixed plurality of musical tone waveform samples in a memory, wherein said musical tone waveform calculation includes a characteristic control processing step of controlling a characteristic of the mixed plurality of musical tone waveform samples in a manner selected by said selection information; and a reproducing step of outputting said plurality of musical tone waveform samples generated by said generating step, sample by sample, every sampling cycle.

15. A method as claimed in claim 14, wherein the plurality of characteristic control processing include at least one of reverberation effect applying processing and low pass filter processing.

16. A method as claimed in claim 14, wherein the received selection information is input based on a setting operation by a user.

17. An apparatus for generating musical tones, comprising:

a computer for executing a musical tone generating process and outputting musical tones corresponding to musical tone waveforms, wherein said musical tone generating process comprises:

a performance information receiving step of receiving performance information which designates a pitch of each of the musical tones to be generated;

a control information receiving step of receiving control information;

a generating step of carrying out, at predetermined time intervals, a musical tone waveform calculation in response to the received performance information, for generating a plurality of musical tone waveform samples for each of a plurality of channels, wherein the predetermined time intervals are longer than a sampling cycle of the musical tone waveform samples, each of the musical tone waveform samples generated has the pitch designated by said performance information, and the number of said waveform sample generated is controlled by said control information; and a reproducing step of playing back said musical tone waveform samples generated by said generating step.

18. An apparatus for generating musical tones, comprising:

a computer for executing a musical tone generating process and outputting musical tones corresponding to musical tone waveforms, wherein said musical tone generating process comprises:

a receiving step of receiving a plurality of pieces of performance information corresponding respectively to a plurality of performance parts, wherein the received performance information designates a pitch of each of the musical tones to be generated;

a generating step of carrying out, at predetermined time intervals, a musical tone waveform calculation in response to the received performance information, for generating a plurality of musical tone waveform samples corresponding to said plurality of performance parts, wherein the predetermined time intervals are longer than a sampling cycle of the musical tone waveform samples, each of the musical tone waveform samples generated has the pitch designated by said performance information, and a sampling frequency of the musical tone waveform samples generated corresponding to at least one of said plurality of performance parts is different from the sampling frequency of the musical tone waveform samples generated corresponding to the other performance parts; and a reproducing step of playing back said musical tone waveform samples generated by said generating step.

19. An apparatus for generating musical tones, comprising:

a computer for executing a musical tone generating process and outputting musical tones corresponding to musical tone waveforms, wherein said musical tone generating process comprises.

a first receiving step of receiving a plurality of pieces of performance information for commanding to generate musical tones;

a second receiving step of receiving limitation information defining a maximum number of channels for generating tones;

a generating step of carrying out, at predetermined time intervals longer than a sampling cycle, a musical tone waveform calculation of a plurality of sounding channels which said performance information has commanded to generate tones, for generating a plurality of musical tone waveform samples in said plurality of sounding channels, wherein when said performance information commands to start generation of a new tone, one new sounding channel is added to said plurality of sounding channels, and when the tone generation in one of said plurality of sounding channels is finished, said one of said plurality of sounding channels is removed from said plurality of sounding channels; and a reproduction step of outputting said plurality of musical tone waveform samples, sample by sample, every sampling cycle;

wherein said generating step generates said musical tone waveform samples by said musical tone waveform calculation in a manner such that a maximum number of said plurality of sounding channels is limited in accordance with said limitation information by inhibiting said musical tone waveform calculation for some of said plurality of sounding channels when a total number of said sounding channels exceeds the maximum number defined by said limitation information.

20. An apparatus for generating musical tones, comprising:

a computer for executing a musical tone generating process and outputting musical tones corresponding to musical tone waveforms, wherein said musical tone generating process comprises:

a first receiving step of receiving a plurality of pieces of performance information for commanding to generate musical tones;

a second receiving step of receiving limitation information defining a maximum amount of processing capacity of a processor of the computer which can be employed for tone generation;

a generating step of carrying out, at predetermined time intervals longer than a sampling cycle, a musical tone waveform calculation of a plurality of sounding channels which said performance information has commanded to generate tones, for generating a plurality of musical tone waveform samples in said plurality of sounding channels, wherein when said performance information commands to start generation of a new tone, one new sounding channel is added to said plurality of sounding channels, and when the tone generation in one of said plurality of sounding channels is finished, said one of said plurality of sounding channels is removed from said plurality of sounding channels; and a reproduction step of outputting said plurality of musical tone waveform samples, sample by sample, every sampling cycle;

wherein said generating step generates said musical tone waveform samples by said musical tone waveform calculation in a manner such that a total number of said plurality of sounding channels is limited in accordance with said limitation information by inhibiting said musical tone waveform calculation for some of said plurality of sounding channels when a total amount of processing capacity of the processor which is used by the musical tone waveform calculation in the generating step exceeds the maximum amount of processing capacity of the processor defined by said limitation information.

21. An apparatus for generating musical tones, comprising:

a computer for executing a musical tone generating process and outputting musical tones corresponding to musical tone waveforms; and a memory for storing musical tone waveform samples;

wherein said musical tone generating process comprises:

a performance information receiving step of receiving performance information which designates a pitch of each of the musical tones to be generated;

a control information receiving step of receiving control information;

a waveform sample generating step of carrying out, at predetermined time intervals longer than a sampling cycle, a musical tone waveform calculation of a plurality of sounding channels which said performance information has commanded to generate tones, for reading musical tone waveform samples from a memory, interpolating the read musical tone waveform samples in a manner selected by the control information, at a rate corresponding to a pitch designated for each of said sounding channels by said performance information, and generating a plurality of musical tone waveform samples for each of said sounding channels based on the musical tone waveform samples interpolated, wherein said musical tone waveform samples generated has the pitch designated by said performance information; and a reproducing step of outputting said musical tone waveform samples generated by said waveform sample generating step, sample by sample, every sampling cycle.

22. An apparatus for generating musical tones, comprising:

a computer for executing a musical tone generating process and outputting musical tones corresponding to musical tone waveforms; and a memory for storing musical tone waveform samples; wherein said musical tone generating process comprises:

a first receiving step of receiving performance information;

a second receiving step of receiving instruction information for instructing a digital filter to switch on or off;

a generating step of carrying out, at predetermined time intervals longer than a sampling cycle, a musical tone waveform calculation in response to the received performance information, for generating a plurality of musical tone waveform samples, and storing the generated plurality of musical tone waveform samples in a memory, wherein said musical tone waveform calculation includes a digital filtering step of filtering said generated plurality of musical tone waveform samples to control a tone color of said musical tone waveform samples, only when said instruction information for instructing the digital filter to switch on is received by said second receiving step; and a reproducing step of outputting said plurality of musical tone waveform samples, sample by sample, every sampling cycle.

23. An apparatus for generating musical tones, comprising:

a computer for executing a musical tone generating process and outputting musical tones corresponding to musical tone waveforms; and a memory for storing musical tone waveform samples; wherein said musical tone generating process comprises:

a first receiving step of receiving performance information;

a second receiving step of receiving instruction information for instructing a low frequency oscillator to switch on or off;

a generating step of carrying out, at predetermined time intervals longer than a sampling cycle, a musical tone waveform calculation in response to the received performance information, for generating a plurality of musical tone waveform samples, and storing the generated plurality of musical tone waveform samples in a memory, wherein said musical tone waveform calculation includes a low frequency oscillator step of imparting vibrato to said generated plurality of musical tone waveform samples, only when said instruction information for instructing the low frequency oscillator to switch on is received by said second receiving step; and a reproducing step of outputting said plurality of musical tone waveform samples, sample by sample, every sampling cycle.

24. An apparatus for generating musical tones, comprising:

a computer for executing a musical tone generating process and outputting musical tones corresponding to musical tone waveforms, wherein said musical tone generating process comprises:

a first receiving step of receiving performance information;

a second receiving step of receiving selection information;

a generating step of carrying out, at predetermined time intervals longer than a sampling cycle, a musical tone waveform calculation in response to the received performance information, for generating a plurality of musical tone waveform samples for each of a plurality of channels, mixing the generated plurality of musical tone waveform samples for each of the plurality of channels, and storing the mixed plurality of musical tone waveform samples in a memory, wherein said musical tone waveform calculation includes a characteristic control processing step of controlling a characteristic of the mixed plurality of musical tone waveform samples in a manner selected by said selection information; and a reproducing step of outputting said plurality of musical tone waveform samples generated by said generating step, sample by sample, every sampling cycle.

25. A machine-readable storage medium storing instructions to cause a machine to perform a method of generating musical tones which is executed on a computer and comprises:

a performance information receiving step of receiving performance information which designates a pitch of each of the musical tones to be generated;

a control information receiving step of receiving control information;

a generating step of carrying out, at predetermined time intervals, a musical tone waveform calculation in response to the received performance information, for generating a plurality of musical tone waveform samples for each of a plurality of channels, wherein the predetermined time intervals are longer than a sampling cycle of the musical tone waveform samples, each of the musical tone waveform samples generated has the pitch designated by said performance information, and the number of said waveform sample generated is controlled by said control information; and a reproducing step of playing back said musical tone waveform samples generated by said generating step.

26. A machine-readable storage medium storing instructions to cause a machine to perform a method of generating musical tones which is executed on a computer and comprises:

a receiving step of receiving a plurality of pieces of performance information corresponding respectively to a plurality of performance parts, wherein the received performance information designates a pitch of each of the musical tones to be generated;

a generating step of carrying out, at predetermined time intervals, a musical tone waveform calculation in response to the received performance information, for generating a plurality of musical tone waveform samples corresponding to said plurality of performance parts, wherein the predetermined time intervals are longer than a sampling cycle of the musical tone waveform samples, each of the musical tone waveform samples generated has the pitch designated by said performance information, and a sampling frequency of the musical tone waveform samples generated corresponding to at least one of said plurality of performance parts is different from the sampling frequency of the musical tone waveform samples generated corresponding to the other performance parts; and a reproducing step of playing back said musical tone waveform samples generated by said generating step.

27. A machine-readable storage medium storing instructions to cause a machine to perform a method of generating musical tones which is executed on a computer and comprises:

a first receiving step of receiving a plurality of pieces of performance information for commanding to generate musical tones;

a second receiving step of receiving limitation information defining a maximum number of channels for generating tones;

a generating step of carrying out, at predetermined time intervals longer than a sampling cycle, a musical tone waveform calculation of a plurality of sounding channels which said performance information has commanded to generate tones, for generating a plurality of musical tone waveform samples in said plurality of sounding channels, wherein when said performance information commands to start generation of a new tone, one new sounding channel is added to said plurality of sounding channels, and when the tone generation in one of said plurality of sounding channels is finished, said one of said plurality of sounding channels is removed from said plurality of sounding channels; and a reproduction step of outputting said plurality of musical tone waveform samples, sample by sample, every sampling cycle;

wherein said generating step generates said musical tone waveform samples by said musical tone waveform calculation in a manner such that a maximum number of said plurality of sounding channels is limited in accordance with said limitation information by inhibiting said musical tone waveform calculation for some of said plurality of sounding channels when a total number of said sounding channels exceeds the maximum number defined by said limitation information.

28. A machine-readable storage medium storing instructions to cause a machine to perform a method of generating musical tones which is executed on a computer and comprises:

a first receiving step of receiving a plurality of pieces of performance information for commanding to generate musical tones;

a second receiving step of receiving limitation information defining a maximum amount of processing capacity of a processor of the computer which can be employed for tone generation;

a generating step of carrying out, at predetermined time intervals longer than a sampling cycle, a musical tone waveform calculation of a plurality of sounding channels which said performance information has commanded to generate tones, for generating a plurality of musical tone waveform samples in said plurality of sounding channels, wherein when said performance information commands to start generation of a new tone, one new sounding channel is added to said plurality of sounding channels, and when the tone generation in one of said plurality of sounding channels is finished, said one of said plurality of sounding channels is removed from said plurality of sounding channels; and a reproduction step of outputting said plurality of musical tone waveform samples, sample by sample, every sampling cycle;

wherein said generating step generates said musical tone waveform samples by said musical tone waveform calculation in a manner such that a total number of said plurality of sounding channels is limited in accordance with said limitation information by inhibiting said musical tone waveform calculation for some of said plurality of sounding channels when a total amount of processing capacity of the processor which is used by the musical tone waveform calculation in the generating step exceeds the maximum amount of processing capacity of the processor defined by said limitation information.

29. A machine-readable storage medium storing instructions to cause a machine to perform a method of generating musical tones which is executed on a computer and comprises:

a performance information receiving step of receiving performance information which designates a pitch of each of the musical tones to be generated;

a control information receiving step of receiving control information;

a waveform sample generating step of carrying out, at predetermined time intervals longer than a sampling cycle, a musical tone waveform calculation of a plurality of sounding channels which said performance information has commanded to generate tones, for reading musical tone waveform samples from a memory, interpolating the read musical tone waveform samples in a manner selected by the control information, at a rate corresponding to a pitch designated for each of said sounding channels by said performance information, and generating a plurality of musical tone waveform samples for each of said sounding channels based on the musical tone waveform samples interpolated, wherein said musical tone waveform samples generated has the pitch designated by said performance information; and a reproducing step of outputting said musical tone waveform samples generated by said waveform sample generating step, sample by sample, every sampling cycle.

30. A machine-readable storage medium storing instructions to cause a machine to perform a method of generating musical tones which is executed on a computer and comprises:

a first receiving step of receiving performance information;

a second receiving step of receiving instruction information for instructing a digital filter to switch on or off;

a generating step of carrying out, at predetermined time intervals longer than a sampling cycle, a musical tone waveform calculation in response to the received performance information, for generating a plurality of musical tone waveform samples, and storing the generated plurality of musical tone waveform samples in a memory, wherein said musical tone waveform calculation includes a digital filtering step of filtering said generated plurality of musical tone waveform samples to control a tone color of said musical tone waveform samples, only when said instruction information for instructing the digital filter to switch on is received by said second receiving step; and a reproducing step of outputting said plurality of musical tone waveform samples, sample by sample, every sampling cycle.

31. A machine-readable storage medium storing instructions to cause a machine to perform a method of generating musical tones which is executed on a computer and comprises:

a first receiving step of receiving performance information;

a second receiving step of receiving instruction information for instructing a low frequency oscillator to switch on or off;

a generating step of carrying out, at predetermined time intervals longer than a sampling cycle, a musical tone waveform calculation in response to the received performance information, for generating a plurality of musical tone waveform samples, and storing the generated plurality of musical tone waveform samples in a memory, wherein said musical tone waveform calculation includes a low frequency oscillator step of imparting vibrato to said generated plurality of musical tone waveform samples, only when said instruction information for instructing the low frequency oscillator to switch on is received by said second receiving step; and a reproducing step of outputting said plurality of musical tone waveform samples, sample by sample, every sampling cycle.

32. A machine-readable storage medium storing instructions to cause a machine to perform a method of generating musical tones which is executed on a computer and comprises:

a first receiving step of receiving performance information;

a second receiving step of receiving selection information;

a generating step of carrying out, at predetermined time intervals longer than a sampling cycle, a musical tone waveform calculation in response to the received performance information, for generating a plurality of musical tone waveform samples for each of a plurality of channels, mixing the generated plurality of musical tone waveform samples for each of the plurality of channels, and storing the mixed plurality of musical tone waveform samples in a memory, wherein said musical tone waveform calculation includes a characteristic control processing step of controlling a characteristic of the mixed plurality of musical tone waveform samples in a manner selected by said selection information; and a reproducing step of outputting said plurality of musical tone waveform samples generated by said generating step, sample by sample, every sampling cycle.

* * * * *